US011892220B2

(12) United States Patent
Lee et al.

(10) Patent No.: US 11,892,220 B2
(45) Date of Patent: Feb. 6, 2024

(54) REFRIGERATOR AND METHOD FOR CONTROLLING SAME

(71) Applicant: LG ELECTRONICS INC., Seoul (KR)

(72) Inventors: Donghoon Lee, Seoul (KR); Wookyong Lee, Seoul (KR); Seungseob Yeom, Seoul (KR); Donghoon Lee, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 208 days.

(21) Appl. No.: 17/281,701

(22) PCT Filed: Oct. 1, 2019

(86) PCT No.: PCT/KR2019/012853

§ 371 (c)(1),
(2) Date: Mar. 31, 2021

(87) PCT Pub. No.: WO2020/071743

PCT Pub. Date: Apr. 9, 2020

(65) Prior Publication Data

US 2021/0372681 A1 Dec. 2, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/18* (2006.01)
*F25C 1/24* (2018.01)
(Continued)

(52) U.S. Cl.
CPC ..... *F25C 1/18* (2013.01); *F25C 1/24* (2013.01); *F25C 5/08* (2013.01); *F25D 29/00* (2013.01);
(Continued)

(58) Field of Classification Search
CPC ..... F25C 1/18; F25C 1/24; F25C 5/08; F25C 2400/06; F25C 2400/10; F25C 2600/04;
(Continued)

(56) References Cited

U.S. PATENT DOCUMENTS 3,459,005 A * 8/1969 Sorensen ..... F25C 1/12 62/138
5,127,236 A * 7/1992 von Blanquet ..... F25C 1/08 62/135
(Continued)

FOREIGN PATENT DOCUMENTS

CN 1461928 12/2003
CN 102549359 7/2012
(Continued)

OTHER PUBLICATIONS

JP2013032871A, machine translation (Year: 2023).*
(Continued)

*Primary Examiner* — Len Tran
*Assistant Examiner* — Kirstin U Oswald
(74) *Attorney, Agent, or Firm* — KED & Associates LLP

(57) ABSTRACT

A refrigerator of the present disclosure can include an ice making cell, a heater configured to supply heat to the ice making cell during an ice making process, and a controller configured to control the heater. The process for controlling the heater includes a basic heating process and an additional heating process that is performed after the basic heating process. In the basic heating process, the controller performs control so that a heating amount of the heater varies accord-
(Continued)

ing to a mass per unit height of water in the ice making cell. In at least partial section of the additional heating process, the controller controls the heater to operate with a heating amount that is equal to or less than a heating amount of the heater in the basic heating process.

24 Claims, 14 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081705 |

(51) Int. Cl.
*F25C 5/08* (2006.01)
*F25D 29/00* (2006.01)

(52) U.S. Cl.
CPC ..... *F25C 2400/06* (2013.01); *F25C 2400/10* (2013.01); *F25C 2600/04* (2013.01); *F25C 2700/12* (2013.01)

(58) Field of Classification Search
CPC .. F25C 2700/12; F25C 5/22; F25C 2305/022; F25D 29/00
USPC ..... 62/66
See application file for complete search history.

(56) References Cited

U.S. PATENT DOCUMENTS

| | | | | |
|---|---|---|---|---|
| 6,951,113 | B1 | 10/2005 | Adamski | |
| 2003/0155467 | A1* | 8/2003 | Petrenko | H05B 3/84 244/134 R |
| 2005/0183427 | A1* | 8/2005 | Dudley | F25D 21/006 62/80 |
| 2006/0086134 | A1* | 4/2006 | Voglewede | F25C 5/06 62/353 |
| 2009/0211267 | A1* | 8/2009 | Kim | F25C 1/08 62/157 |
| 2012/0198863 | A1* | 8/2012 | Hall | F25D 21/08 62/126 |
| 2013/0081412 | A1* | 4/2013 | Son | F25C 5/04 62/340 |
| 2014/0182325 | A1 | 7/2014 | Lee et al. | |
| 2016/0370085 | A1 | 12/2016 | Kim | |
| 2017/0089629 | A1* | 3/2017 | Ji | F25C 5/08 |
| 2018/0216863 | A1* | 8/2018 | Ji | F25C 5/08 |
| 2019/0219317 | A1* | 7/2019 | Yoon | F25C 1/18 |

FOREIGN PATENT DOCUMENTS

| | | |
|---|---|---|
| EP | 3059526 | 8/2016 |
| JP | H02-254276 | 10/1990 |
| JP | H05-203299 | 8/1993 |
| JP | H05-203302 | 8/1993 |
| JP | 09-269172 | 10/1997 |
| JP | 2003-114072 | 4/2003 |
| JP | 2004-045002 | 2/2004 |
| JP | 2005-188912 | 7/2005 |
| JP | 2005-326035 | 11/2005 |
| JP | 4572833 | 11/2010 |
| JP | 2011-064371 | 3/2011 |
| JP | 2011-064373 | 3/2011 |
| JP | 2011-237077 | 11/2011 |
| JP | 2013-032878 | 2/2013 |
| JP | 2013032871 A * | 2/2013 |
| KR | 10-2003-0051546 | 6/2003 |
| KR | 10-2005-0069319 | 7/2005 |
| KR | 10-2005-0096336 | 10/2005 |
| KR | 10-0567864 | 4/2006 |
| KR | 10-2013-0009332 | 1/2013 |
| KR | 10-2013-0009521 | 1/2013 |
| KR | 10-2014-0088321 | 7/2014 |
| KR | 10-1643635 | 7/2016 |
| KR | 10-1850918 | 5/2018 |
| KR | 10-2018-0093666 | 8/2018 |
| KR | 10-2018-0100752 | 9/2018 |

OTHER PUBLICATIONS

International Search Report dated Jan. 16, 2020 issued in Application No. PCT/KR2019/012853.
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
Chinese Office Action dated Jun. 6, 2022 issued in Application No. 201980063550.9.
Extended European Search Report dated Jun. 21, 2022 issued in Application No. 19868711.3.
Korean Office Action dated Jul. 4, 2023 issued in Application No. 10-2018-0142117.
Korean Notice of Allowance dated Nov. 7, 2023, issued in Application No. 10-2018-0117821.

* cited by examiner

【FIG. 1B】
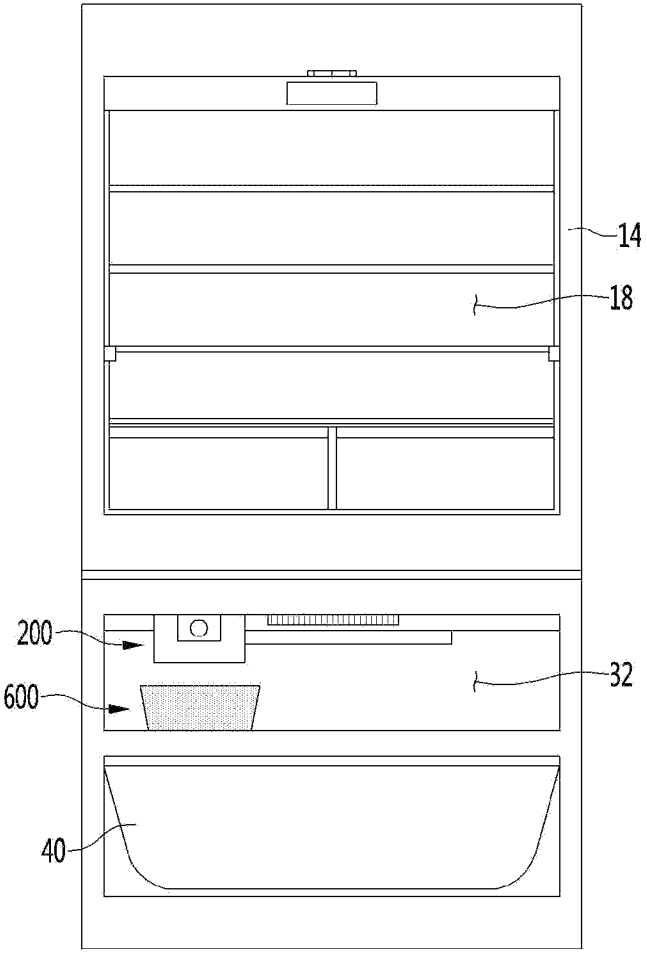
【FIG. 1A】
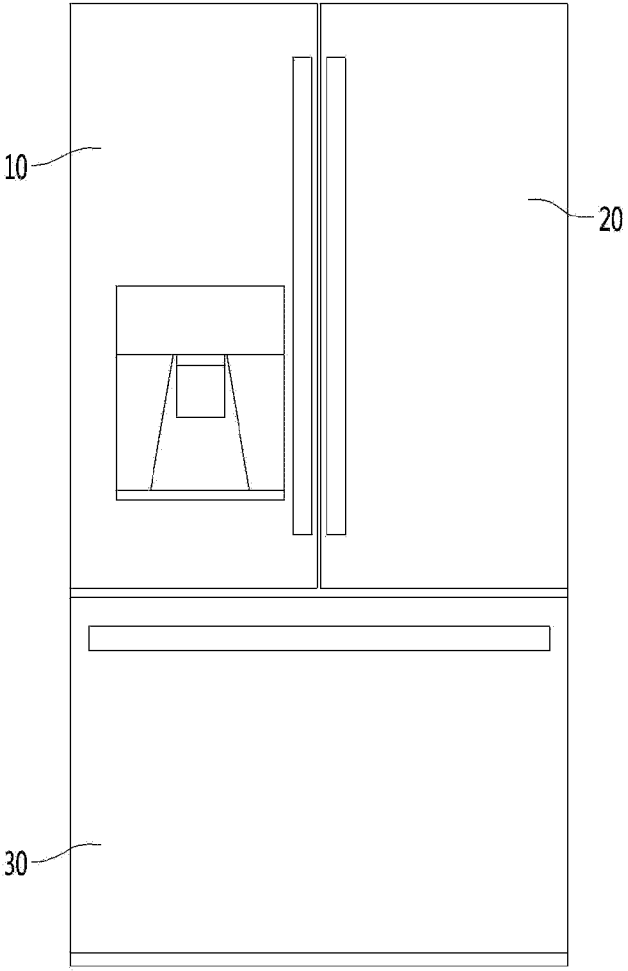

【FIG. 2】
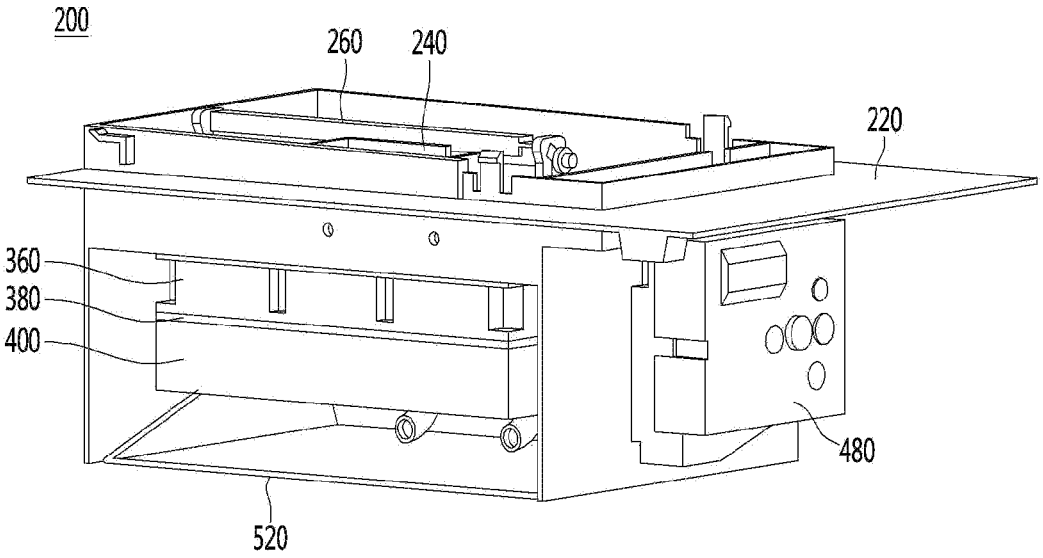
【FIG. 3】
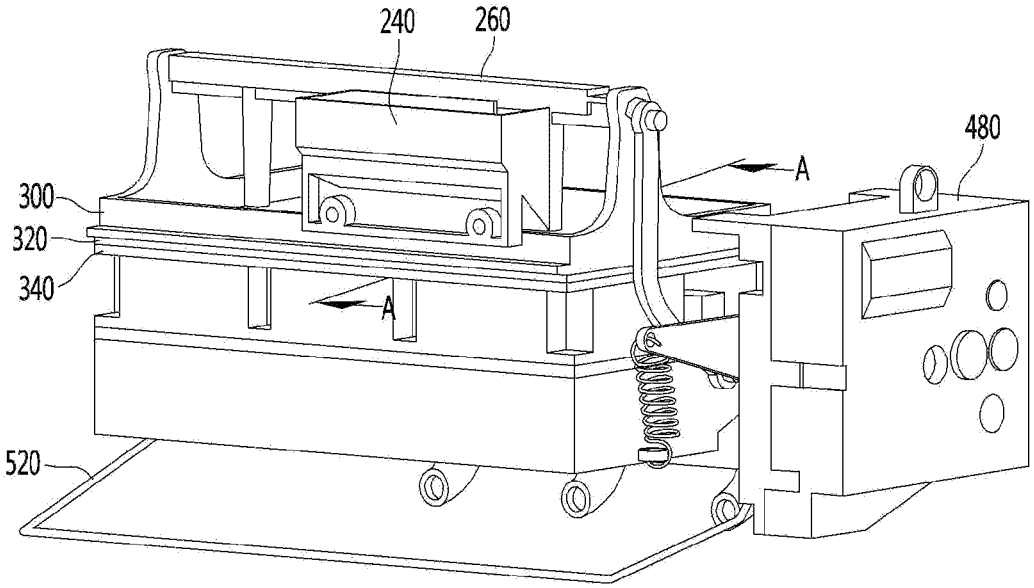

【FIG. 4】
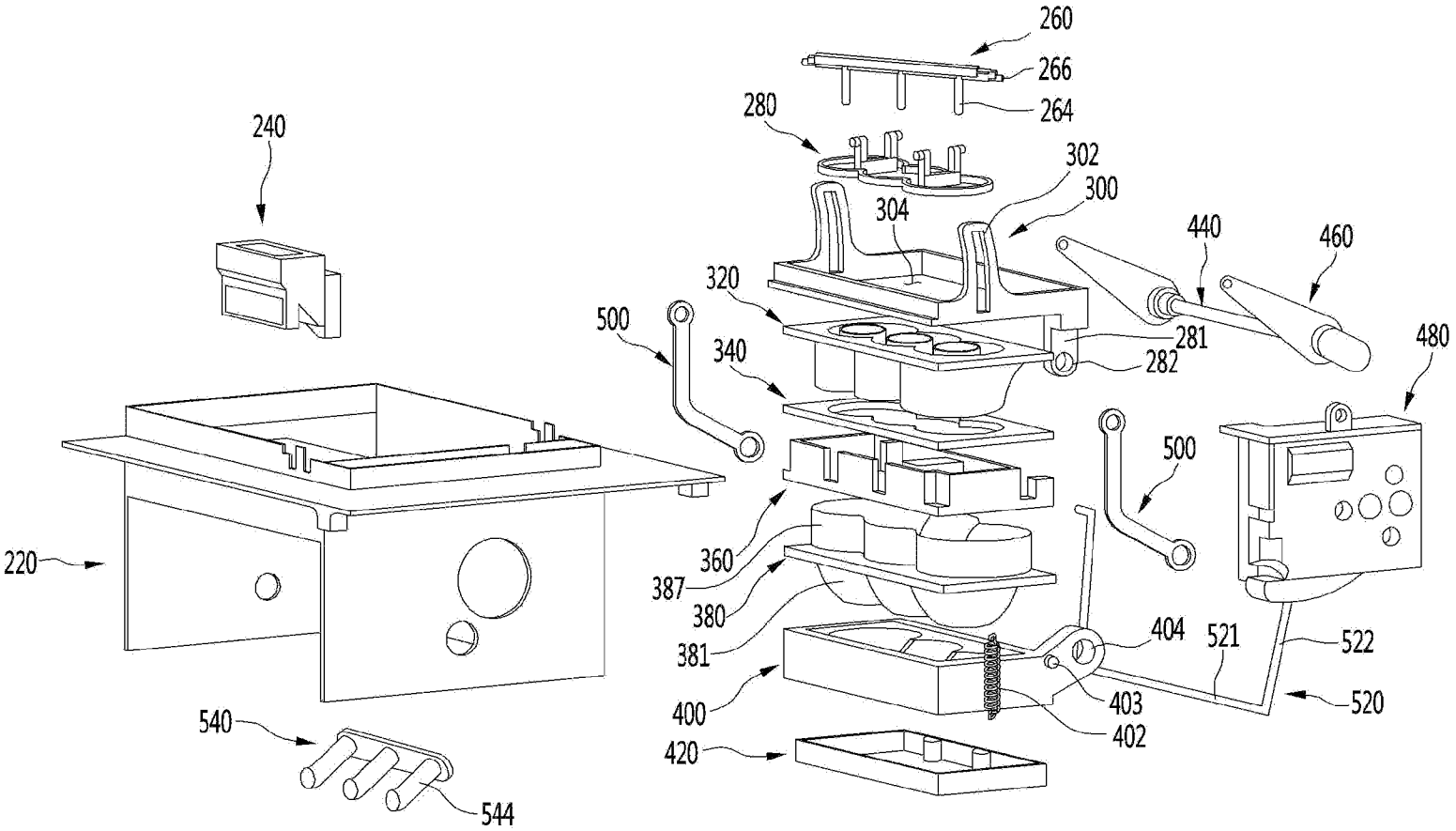

【FIG. 5】
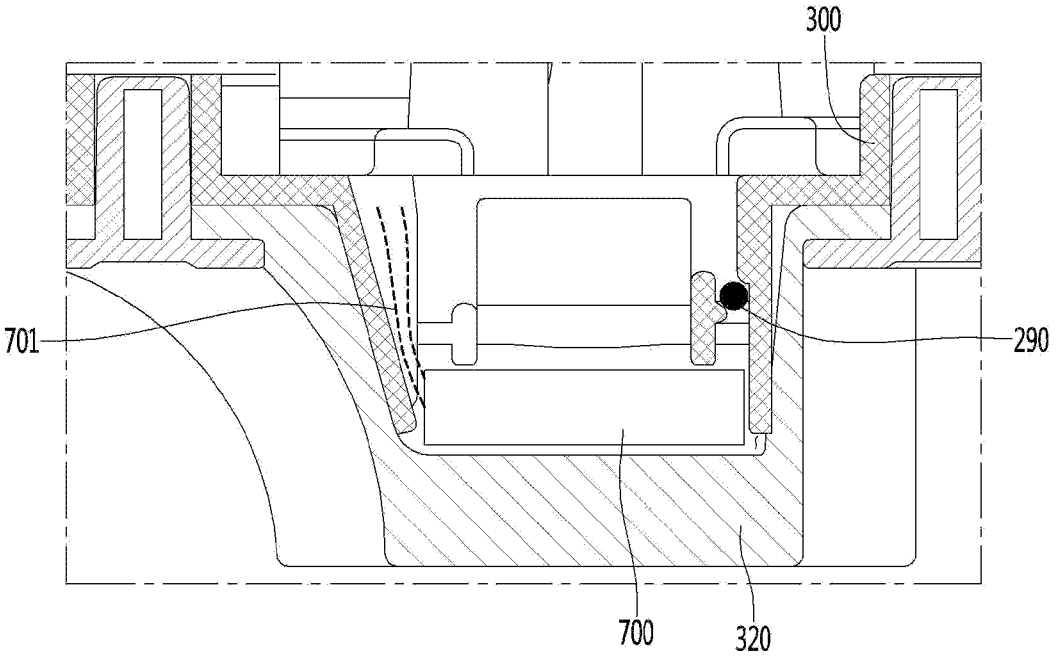

【FIG. 6】
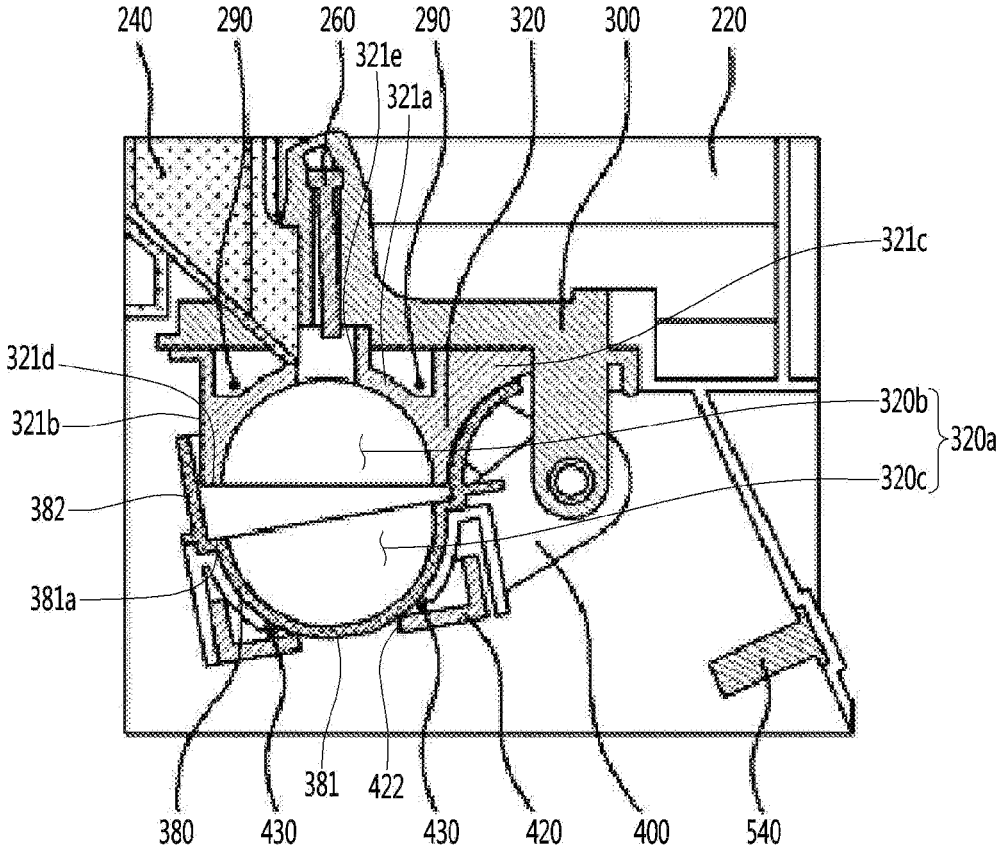

【FIG. 7】
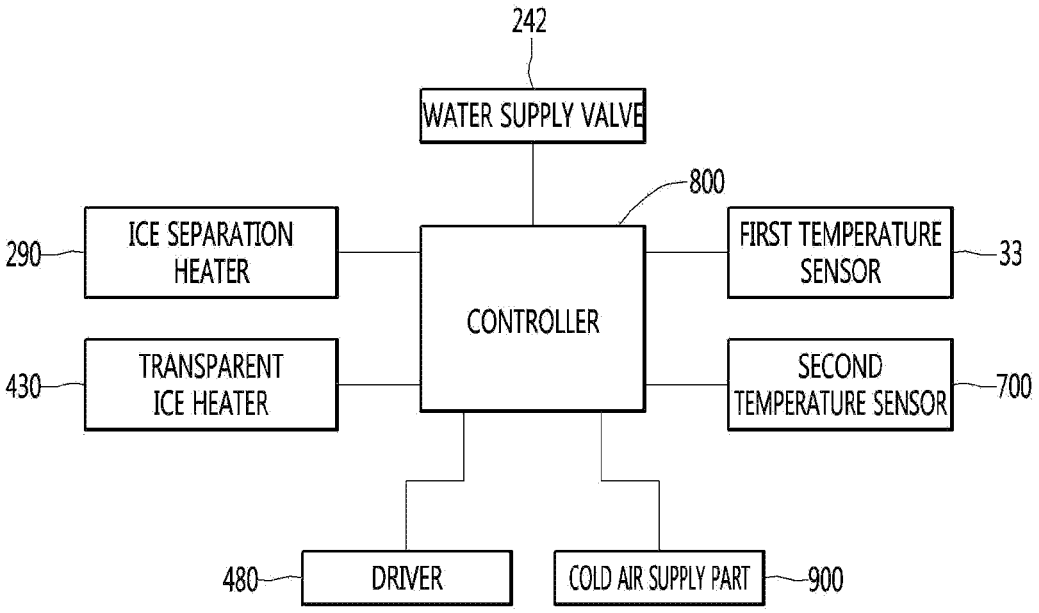

【FIG. 8】
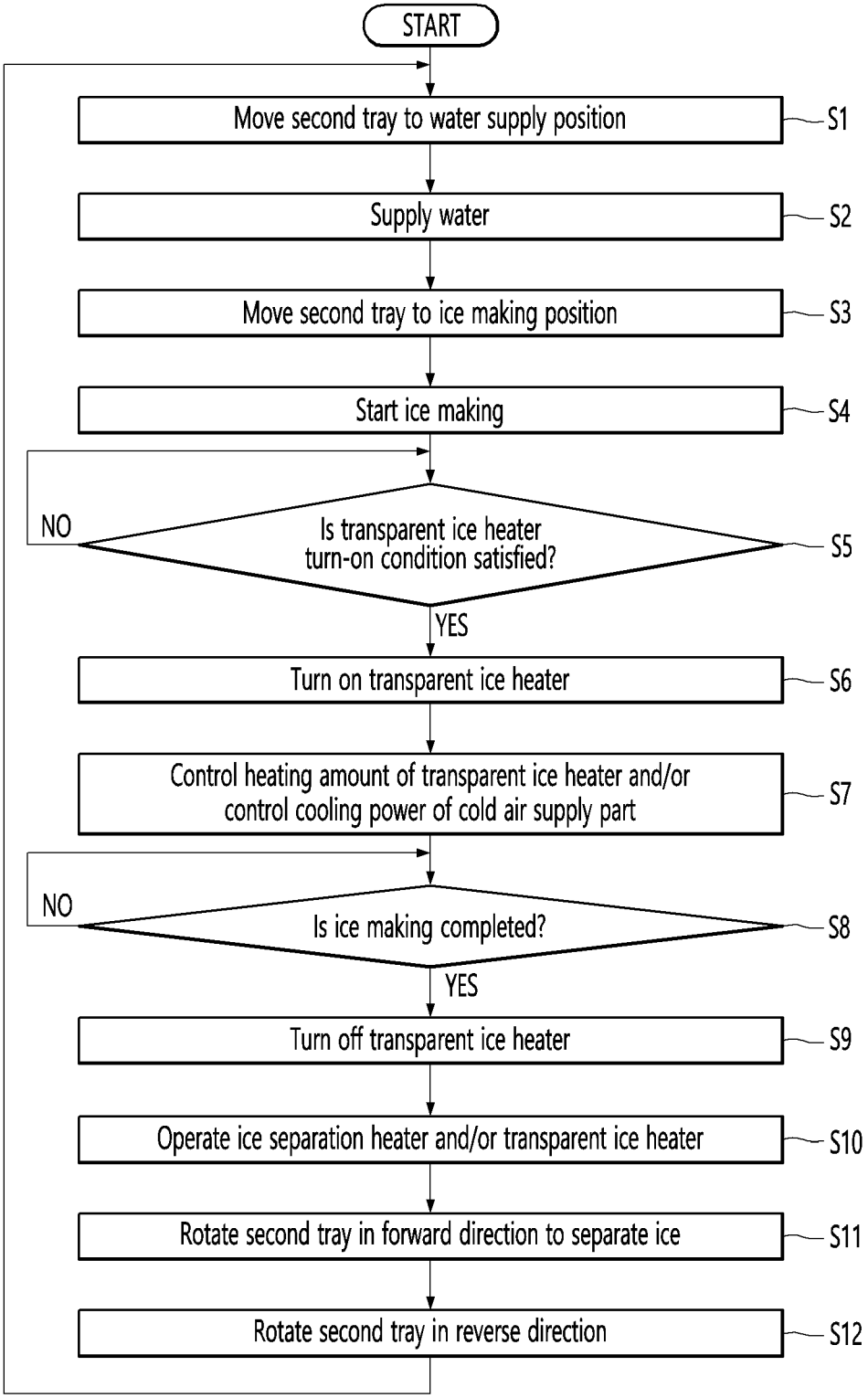

【FIG. 9A】
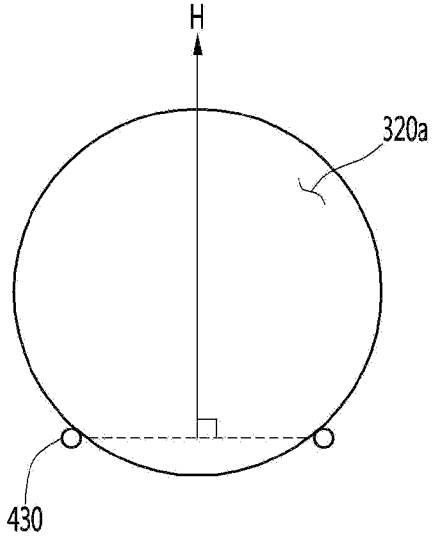
【FIG. 9B】
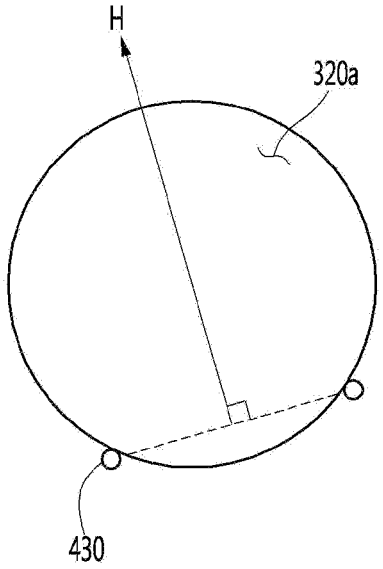
【FIG. 10A】
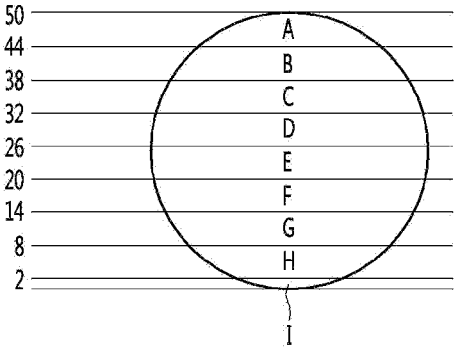
【FIG. 10B】
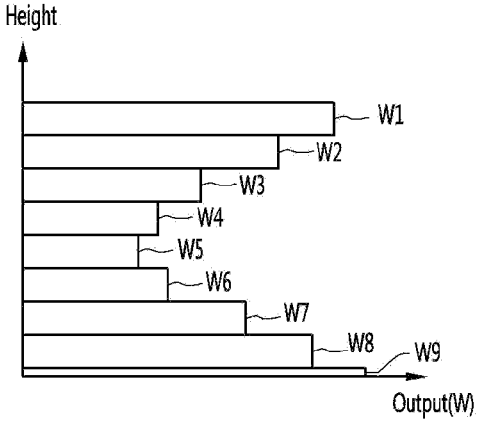

【FIG. 11】
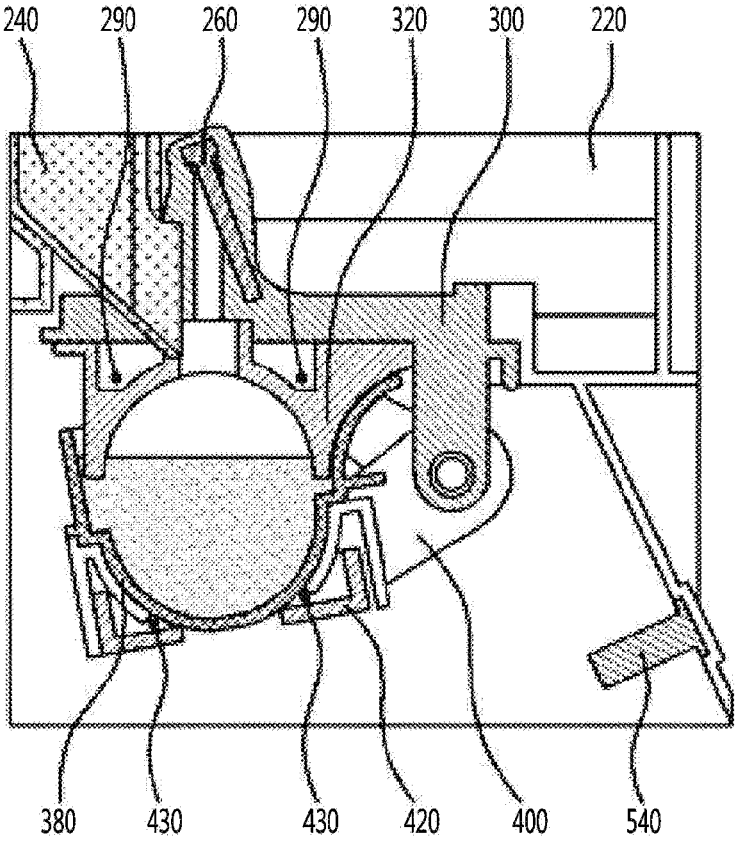

【FIG. 12】
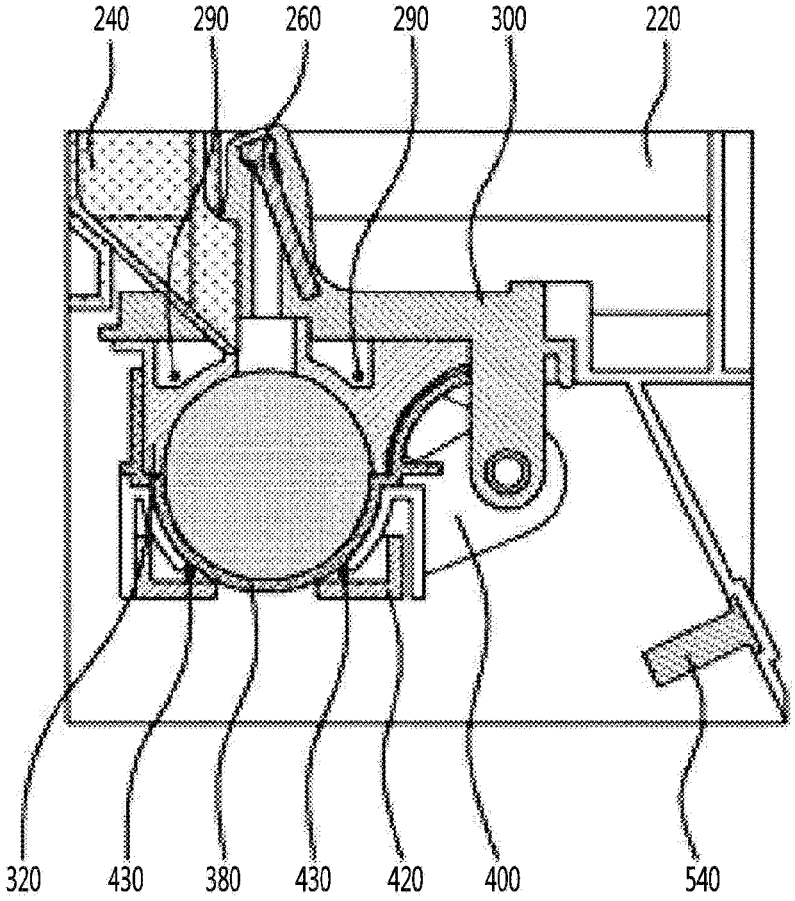

【FIG. 13】
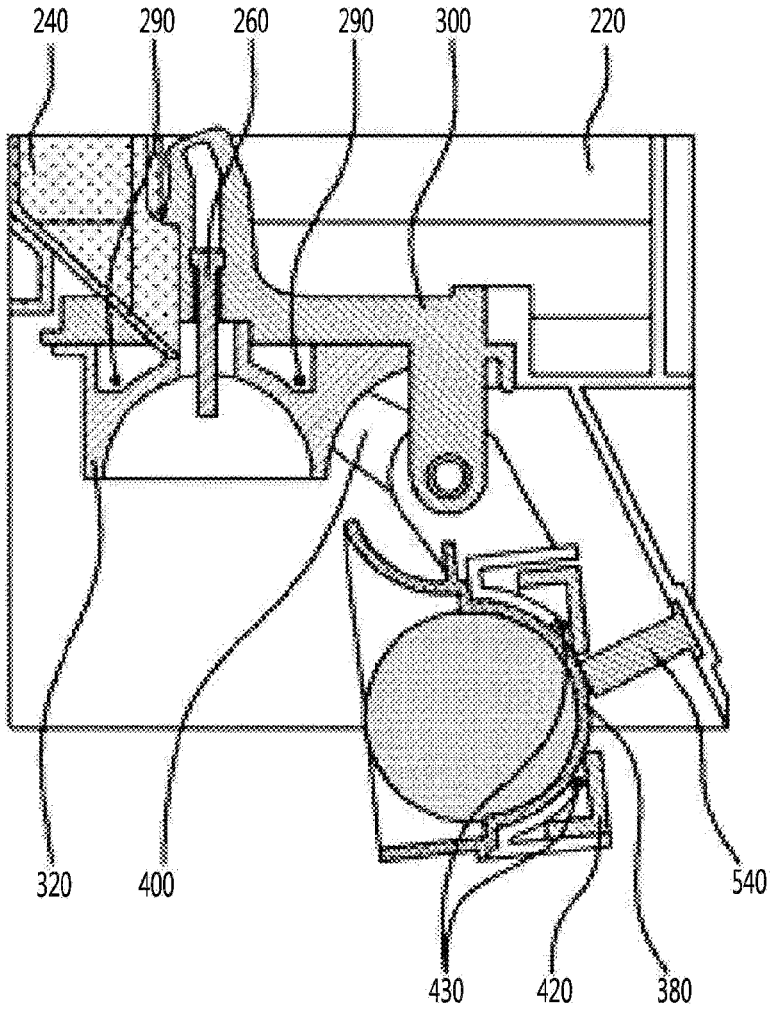

【FIG. 14】
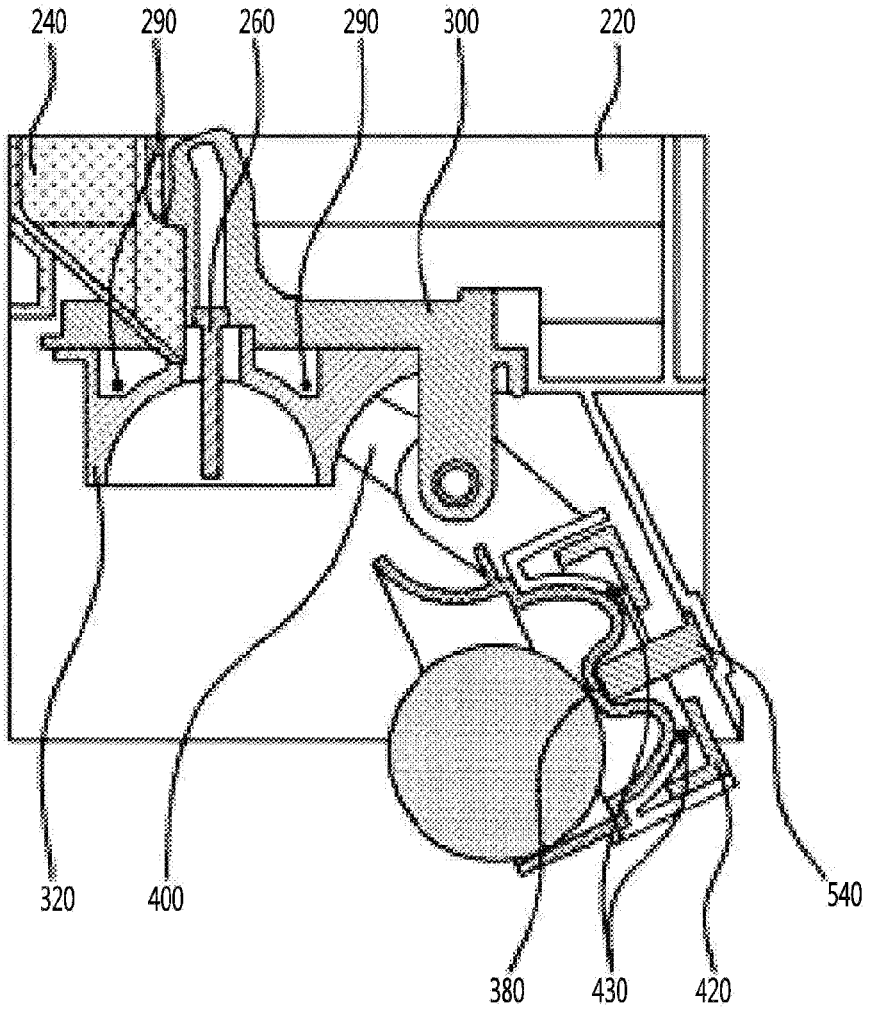

【FIG. 15】
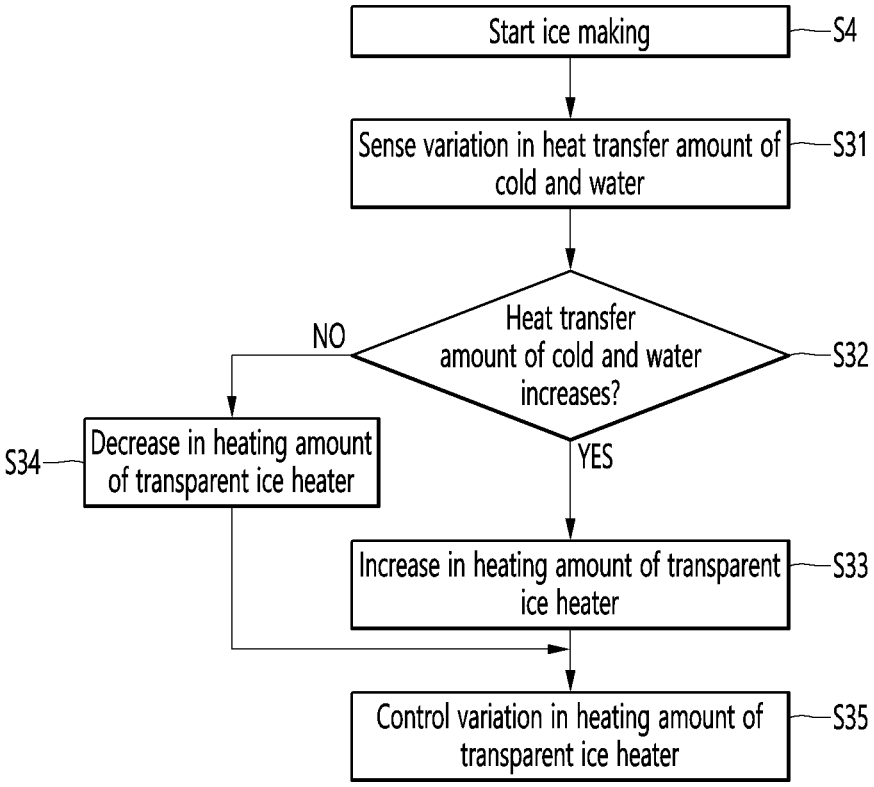

【FIG. 16】

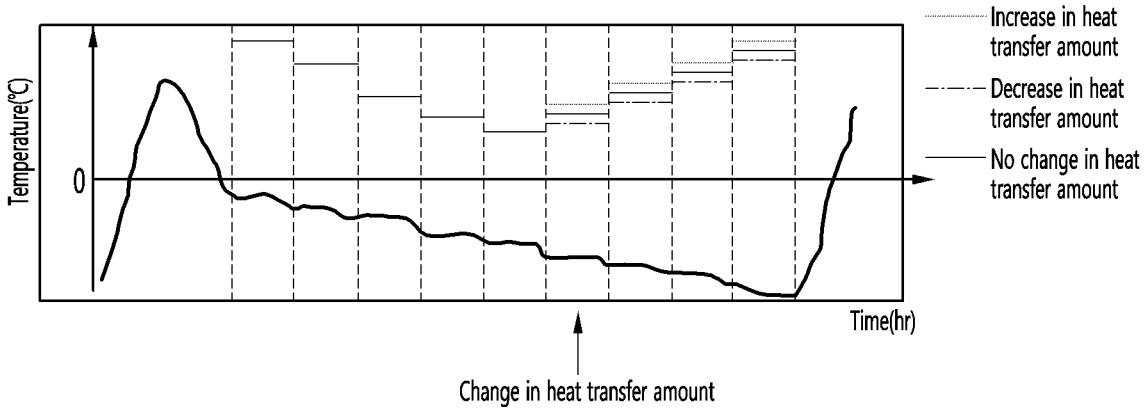

【FIG. 17】

| | process | weak | medium | strong | time | temperature |
|---|---|---|---|---|---|---|
| Basic heating process | 1 process | A1 | B1 | C1 | T1 | |
| | 2 process | A2 | B2 | C2 | T1 | |
| | 3 process | A3 | B3 | C3 | T1 | |
| | 4 process | A4 | B4 | C4 | T1 | |
| | 5 process | A5 | B5 | C5 | T1 | |
| | 6 process | A6 | B6 | C6 | T1 | |
| | 7 process | A7 | B7 | C7 | T1 | |
| | 8 process | A8 | B8 | C8 | T1 | |
| | 9 process | A9 | B9 | C9 | T1 | |
| | 10 process | A10 | B10 | C10 | T1 | & limit temperature |
| Additional heating process | 11 process | A11 | B11 | C11 | T2 | |
| | 12 process | A12 | B12 | C12 | T3 | or end reference temperature |
| | 13 process | A13 | B13 | C13 | T4 | or end reference temperature |
| | 14 process | A14 | B14 | C14 | T5 | or end reference temperature |
| | 15 process | A15 | B15 | C15 | T6 | or end reference temperature |

REFRIGERATOR AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2019/012853, filed Oct. 1, 2019, which claims priority to Korean Patent Application Nos. 10-2018-0117785, 10-2018-0117819, 10-2018-0117821, 10-2018-0117822, all filed on Oct. 2, 2018, 10-2018-0142117, filed Nov. 16, 2018 and 10-2019-0081705, filed Jul. 6, 2019, whose entire disclosures are hereby incorporated by reference.

TECHNICAL FIELD

The present disclosure relates to a refrigerator and a method for controlling the same.

BACKGROUND ART

In general, refrigerators are home appliances for storing foods at a low temperature in a storage chamber that is covered by a door.

The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray. The ice maker may separate the made ice from the ice tray in a heating manner or twisting manner. As described above, the ice maker through which water is automatically supplied, and the ice automatically separated may be opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate.

In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice.

When growth of the transparent ice proceeds to reduce a volume of the water within the ice making block, the solidification rate is gradually increased, and thus, sufficient convection suitable for the solidification rate may not occur.

Thus, in the case of the prior art document 2, when about ⅔ of water is solidified, a heating amount of heater increases to suppress an increase in the solidification rate.

However, the prior art document 2 discloses a feature in which when the volume of water is simply reduced, only the heating amount of heater increases and does not disclose a structure and a heater control logic for making ice having high transparency without reducing the ice making rate.

DISCLOSURE

Technical Problem

Embodiments provide a refrigerator capable of making ice having uniform transparency as a whole regardless of shape, and a method for controlling the same.

Embodiments provide a refrigerator capable of making spherical ice and having uniform transparency for each unit height of the spherical ice, and a method for controlling the same.

Embodiments provide a refrigerator capable of making ice having uniform transparency as a whole by varying a heating amount of a transparent ice heater and/or cooling power of a cold air supply part in response to the change in the heat transfer amount between water in an ice making cell and cold air in a storage chamber, and a method for controlling the same.

Embodiments provide a refrigerator capable of completely making ice in each of a plurality of ice making cells by controlling a heater in consideration of variations in ice making rates between the plurality of ice making cells, and a method for controlling the same.

Embodiments provide a refrigerator capable of completely making ice in an ice making cell through an additional heating process of a transparent ice heater even when a temperature of a storage chamber increases or cold air supplied to the storage chamber decreases, and a method for controlling the same.

Technical Solution

According to one aspect, a refrigerator may include an ice maker including an ice making cell that is a space in which water is phase-changed into ice. A cooler may supply cold to a storage chamber in which food is stored. Water in the ice making cell may be phase-changed into ice by the cold. The ice maker may include a heater configured to supply heat into the ice making cell. The heater may be controlled by a controller.

The heater may be turned on in at least partial section while the cooler supplies the cold to the ice making cell so that bubbles dissolved in the water within the ice making cell moves from a portion, at which the ice is made, toward the water that is in a liquid state to make transparent ice.

The ice maker may include a first tray defining a portion of the ice making cell and a second tray defining another portion of the ice making cell. The heater may be disposed at one side of the first tray or the second tray.

The second tray may contact the first tray in an ice making process and may be spaced apart from the first tray in an ice separation process. The second tray may be connected to a driver to receive power from the driver. Due to the operation of the driver, the second tray may move from a water supply position to an ice making position. Also, due to the operation of the driver, the second tray may move from the ice making position to an ice separation position.

The water supply of the ice making cell starts when the second tray moves to a water supply position. After the water supply is completed, the second tray may be moved to the ice making position. After the second tray moves to the ice making position, the cooler supplies the cold to the ice making cell. When the ice is completely made in the ice making cell, the second tray move to the ice separation position in a forward direction so as to take out the ice in the ice making cell. After the second tray moves to the ice separation position, the second tray may move to the water supply position in the reverse direction, and the water supply may start again.

The controller may control one or more of cooling power of the cooler and the heating amount of heater to vary according to a mass per unit height of water in the ice making cell, so that the transparency for each unit height of the water in the ice making cell is uniform.

According to one aspect, the process for controlling the heater may include a basic heating process and an additional heating process that is performed after the basic heating process.

The controller may control the heater so that the heating amount of the heater varies during the ice making process.

In at least partial section of the additional heating process, the controller may control the heater to operate with a heating amount that is equal to or less than a heating amount of the heater in the basic heating process.

The basic heating process may include a plurality of processes. The heating amount of the heater may vary for each of the plurality of processes, or the heating amount of the heater may be equal in at least two of the plurality of processes.

The basic heating process may be ended when the temperature sensed by the temperature sensor reaches a limit temperature that is a sub-zero temperature.

Some or all of the plurality of processes may be performed for a first set time.

The additional heating process may include a first additional process of operating the heater with a set heating amount for a second set time. The heating amount of the heater in the first additional process may be smaller than the heating amount of the heater when the basic heating process is ended. The heating amount of the heater in the first additional process may be a minimum heating amount of the heater in the basic heating process. The second set time may be longer than the first set time.

The additional heating process may further include a second additional process that is performed after the end of the first additional process. The heating amount of the heater in the second additional process may be equal to or smaller than the heating amount of the heater in the first additional process. When the third set time elapses or the temperature sensed by the second temperature sensor before the elapse of the third set time reaches an end reference temperature, the second additional process may be ended. The third set time may be equal to or shorter than the second set time. When the temperature sensed by the second temperature sensor before the elapse of the third set time reaches the end reference temperature and the second additional process is ended, the additional heating process may be ended.

The additional heating process may further include a third additional process that is performed when the temperature sensed by the second temperature sensor does not reach the end reference temperature in a state in which the third set time elapses. The heating amount of the heater in the third additional process may be equal to or smaller than the heating amount of the heater in the second additional process. When the fourth set time elapses or the temperature sensed by the second temperature sensor before the elapse of the fourth set time reaches the end reference temperature, the third additional process may be ended. When the temperature sensed by the second temperature sensor before the elapse of the fourth set time reaches the end reference temperature and the third additional process is ended, the additional heating process may be ended.

The additional heating process may further include a fourth additional process that is performed when the temperature sensed by the second temperature sensor does not reach the end reference temperature in a state in which the fourth set time elapses. The heating amount of the heater in the fourth additional process may be smaller than the heating amount of the heater in the third additional process. When the fifth set time elapses or the temperature sensed by the second temperature sensor before the elapse of the fifth set time reaches the end reference temperature, the fourth additional process may be ended. When the temperature sensed by the second temperature sensor before the elapse of the fifth set time reaches the end reference temperature and the fourth additional process is ended, the additional heating process may be ended.

The additional heating process may further include a fifth additional process that is performed when the temperature sensed by the second temperature sensor does not reach the end reference temperature in a state in which the fifth set time elapses. The heating amount of the heater in the fifth additional process may be smaller than the heating amount of the heater in the fourth additional process. The heating amount of the heater in the fifth additional process may be ½ of the heating amount of the heater in the fourth additional process. When the sixth set time elapses or the temperature sensed by the second temperature sensor before the elapse of the fifth set time reaches the end reference temperature, the fifth additional process may be ended. The sixth set time may be longer than the first to fifth set times.

According to another aspect, the additional heating process may include a first additional process of operating the heater with a set heating amount. The heating amount of the heater in the first additional process may be smaller than a minimum heating amount of the heater in the basic heating process.

When the fourth set time elapses or the temperature sensed by the second temperature sensor before the elapse of the fourth set time reaches the end reference temperature, the first additional process may be ended.

The additional heating process may further include a second additional process that is performed when the temperature sensed by the second temperature sensor does not reach the end reference temperature in a state in which the fourth set time elapses. The heating amount of the heater in the second additional process may be smaller than the heating amount of the heater in the first additional process. When the fifth set time elapses or the temperature sensed by the second temperature sensor before the elapse of the fifth set time reaches the end reference temperature, the second additional process may be ended. When the temperature sensed by the second temperature sensor before the elapse of the fifth set time reaches the end reference temperature and the second additional process is ended, the additional heating process may be ended.

The additional heating process may further include a third additional process that is performed when the temperature sensed by the second temperature sensor does not reach the end reference temperature in a state in which the fifth set time elapses. The heating amount of the heater in the third additional process may be smaller than the heating amount of the heater in the second additional process. When the sixth set time elapses or the temperature sensed by the second temperature sensor before the elapse of the fifth set time reaches the end reference temperature, the third additional process may be ended.

According to another aspect, a method for controlling a refrigerator relates to a method for controlling a refrigerator that includes a first tray accommodated in a storage chamber, a second tray configured to define an ice making cell together with the first tray, a driver configured to move the second tray, and a heater configured to supply heat to at least one of the first tray and the second tray.

The method for controlling the refrigerator may include: performing water supply of the ice making cell when the second tray moves to a water supply position; performing ice making after the water supply is completed and the second tray moves from the water supply position to an ice making position in a reverse direction; and moving the second tray from the ice making position to an ice separation position in a forward direction when the ice making is completed.

The performing of the ice making may include a basic heating process of operating the heater to heat the ice making cell and an additional heating process of additionally heating the ice making cell after the basic heating process is ended. The maximum heating amount of the heater in the additional heating process may be smaller than the maximum heating amount of the heater in the basic heating process. The additional heating process may be ended in a state in which the heating amount of the heater is constantly maintained in the additional heating process.

The additional heating process may include a plurality of processes, and the heating amount of the heater in the first process among the plurality of processes may be maximum and the heating amount of the heater in the last process may be minimum.

According to further another aspect, a refrigerator may include a heater disposed around an ice making cell to make transparent ice in the ice making cell, and a controller configured to control the heater. The controller may control the heater to be turned on to make transparent ice.

The process for controlling the heater may include a basic heating process and an additional heating process that is performed after the basic heating process.

In at least partial section of the additional heating process, the controller may control the heater to operate with a heating amount that is equal to or less than a heating amount of the heater in the basic heating process.

The basic heating process may include a plurality of processes.

The controller may perform control to proceed from a current process to a next process among the plurality of processes of the basic heating process when a predetermined time elapses or when a value measured by the temperature sensor configured to sense the temperature of the ice making cell reaches a reference value.

The refrigerator may include a plurality of ice making cells. The controller may perform control so that a last process of the basic heating process is ended when the value measured by the temperature sensor reaches the reference value. In this case, the controller may control at least one of the plurality of ice making cells to complete the ice making. According to another aspect, when the time when the value measured by the temperature sensor reaches the reference value may be understood as being designed as the time point when at least one of the plurality of ice making cells completes ice making. As described above, since the end condition of the last process of the basic heating process uses at least the value measured by the temperature sensor, it may be advantageous in satisfying the basic ice making completion condition.

In the basic heating process, the controller may perform control so that the heating amount of the heater varies according to a mass per unit height of water in the ice making cell.

The controller may perform control so that the heating amount supplied by the heater when the mass per unit height of the water in the ice making cell is large is less than the heating amount supplied by the heater when the mass per unit height of the water in the ice making cell is small.

When the basic heating process includes three or more processes, the controller may perform control so that the heating amount supplied by the heater in any one of the processes in which the mass per unit height of water in the ice making cell is large is less than the heating amount supplied by the heater in any one of the processes in which the mass per unit height of water in the ice making cell is small.

According to a modified embodiment, in the basic heating process, the controller may perform control so that an amount of cold supply of the cooler varies according to the mass per unit height of water in the ice making cell.

The controller may perform control so that the amount of cold supplied by the cooler when the mass per unit height of the water in the ice making cell is large is greater than the amount of cold supplied by the cooler when the mass per unit height of the water in the ice making cell is small.

When the basic heating process includes three or more processes, the controller may perform control so that the amount of cold supplied by the cooler in any one of the processes in which the mass per unit height of water in the ice making cell is large is greater than the amount of cold supplied by the cooler in any one of the processes in which the mass per unit height of water in the ice making cell is small.

The additional heating process may include a plurality of processes.

The controller may perform control to proceed from a current process to a next process among the plurality of processes of the additional heating process when a predetermined time elapses or when a value measured by the temperature sensor reaches a reference value.

The refrigerator may include a plurality of ice making cells. The controller may perform control so that a first process of the additional heating process is ended when a predetermined time elapses.

In this case, the controller may control to reduce the making of ice that does not freeze due to non-uniformity at the time when ice making between the plurality of ice making cells is completed. According to another aspect, when the predetermined time elapses, it may be understood as a time point at which at least one of the cells in which ice making is completed late among the plurality of ice making cells is ensured to be completed. As described above, since the end condition of the first process of the additional heating process is at least the one that has passed the predetermined time, it may be understood as a forced driving time in consideration of the difference between the time points at which ice making of a plurality of ice making cells is completed.

According to still another aspect, a refrigerator includes: a storage chamber configured to store food; a cooler configured to supply cold into the storage chamber; a ice maker comprising an ice making cell, which is a space in which water is phase-changed into ice by cold; a heater configured to supply heat into the ice making cell; and a controller configured to control the heater, wherein the controller controls the heater to operate in at least partial section while the cooler supplies the cold so that bubbles dissolved in the water within the ice making cell moves from a portion, at which the ice is made, toward the water that is in a liquid state to make transparent ice, the process for controlling the heater comprises a basic heating process and an additional heating process that is performed after the basic heating process, in the basic heating process, the controller performs control so that a heating amount of the heater varies according to a mass per unit height of water in the ice making cell, and in at least partial section of the additional heating process, the controller controls the heater to operate with a heating amount that is equal to or less than a heating amount of the heater in the basic heating process.

According to still further aspect, a refrigerator includes: a storage chamber configured to store food; a cooler configured to supply cold into the storage chamber; a ice maker comprising an ice making cell, which is a space in which water is phase-changed into ice by cold; a temperature sensor configured to sense a temperature of the water or the ice within the ice making cell; a heater configured to supply heat into the ice making cell; and a controller configured to control the heater, wherein the controller controls the heater to be turned on in at least partial section while the cooler supplies the cold so that bubbles dissolved in the water within the ice making cell moves from a portion, at which the ice is made, toward the water that is in a liquid state to make transparent ice, the process for controlling the heater comprises a basic heating process and an additional heating process that is performed after the basic heating process, and in at least partial section of the additional heating process, the controller controls the heater to operate with a heating amount that is equal to or less than a heating amount of the heater in the basic heating process.

Advantageous Effects

According to the embodiments, since the heater is turned on in at least a portion of the sections while the cooler supplies cold, the ice making rate may decrease by the heat of the heater so that the bubbles dissolved in the water inside the ice making cell move toward the liquid water from the portion at which the ice is made, thereby making the transparent ice.

In particular, according to this embodiment, one or more of the cooling power of the cooler and the heating amount of the heater may be controlled to vary according to the mass per unit height of water in the ice making cell to make the ice having the uniform transparency as a whole regardless of the shape of the ice making cell.

Also, the heating amount of the transparent ice heater and/or the cooling power of the cold air supply part may vary in response to the change in the heat transfer amount between the water in the ice making cell and the cold in the storage chamber, thereby making the ice having the uniform transparency as a whole.

In addition, ice may be completely made in each of a plurality of ice making cells by controlling a heater in consideration of variations in ice making rates between the plurality of ice making cells.

In addition, according to this embodiment, ice may be completely made ice in an ice making cell through an additional heating process of a transparent ice heater even when a temperature of a storage chamber increases or cold air supplied to the storage chamber decreases.

DESCRIPTION OF DRAWINGS

FIGS. 1A and 1B are front views of a refrigerator according to an embodiment.

FIG. 2 is a perspective view of an ice maker according to an embodiment.

FIG. 3 is a perspective view illustrating a state in which a bracket is removed from the ice maker of FIG. 2.

FIG. 4 is an exploded perspective view of the ice maker according to an embodiment.

FIG. 5 is a cross-sectional view taken along line A-A of FIG. 3 for showing a second temperature sensor installed in an ice maker according to an embodiment.

FIG. 6 is a longitudinal cross-sectional view of an ice maker when a second tray is disposed at a water supply position according to an embodiment.

FIG. 7 is a block diagram illustrating a control of a refrigerator according to an embodiment.

FIG. 8 is a flowchart for explaining a process of making ice in the ice maker according to an embodiment.

FIGS. 9A and 9B are views for explaining a height reference depending on a relative position of the transparent heater with respect to the ice making cell.

FIGS. 10A and 10B are views for explaining an output of the transparent heater per unit height of water in the ice making cell.

FIG. 11 is a view illustrating a state in which supply of water is completed at a water supply position.

FIG. 12 is a view illustrating a state in which ice is made at an ice making position.

FIG. 13 is a view illustrating a state in which a second tray is separated from a first tray during an ice separation process.

FIG. 14 is a view illustrating a state in which a second tray is moved to an ice separation position during an ice separation process.

FIG. 15 is a view for explaining a method for controlling a refrigerator when a heat transfer amount between cold air and water varies in an ice making process.

FIG. 16 is a graph showing a change in output of a transparent ice heater according to an increase/decrease in heat transfer amount of cold air and water.

FIG. 17 is a view illustrating an output for each control process of a transparent ice heater in an ice making process.

MODE FOR INVENTION

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

The refrigerator according to an embodiment may include a tray assembly defining a portion of an ice making cell that is a space in which water is phase-changed into ice, a cooler supplying cold air to the ice making cell, a water supply part supplying water to the ice making cell, and a controller.

The refrigerator may further include a temperature sensor detecting a temperature of water or ice of the ice making cell. The refrigerator may further include a heater disposed adjacent to the tray assembly. The refrigerator may further include a driver to move the tray assembly.

The heater may supply heat to the ice making cell and/or the tray assembly.

The refrigerator may further include a storage chamber in which food is stored in addition to the ice making cell. The refrigerator may further include a cooler supplying cold to the storage chamber. The refrigerator may further include a temperature sensor sensing a temperature in the storage chamber. The controller may control at least one of the water supply part or the cooler. The controller may control at least one of the heater or the driver.

The cooler may be defined as a part configured to cool the storage chamber that includes at least one of a cold air supply part including an evaporator and a thermoelectric element.

Hereinafter, embodiments of the refrigerator will be described in detail with reference to the drawings. An example in which the cooler includes the cold air supply part will be described.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 14 is disposed at an upper side, and the freezing compartment 32 is disposed at a lower side. Each of the storage chambers may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 falls to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

FIG. 2 is a perspective view of an ice maker according to an embodiment, FIG. 3 is a perspective view illustrating a state in which a bracket is removed from the ice maker of FIG. 2, and FIG. 4 is an exploded perspective view of the ice maker according to an embodiment. FIG. 5 is a cross-sectional view taken along line A-A of FIG. 3 for showing a second temperature sensor installed in an ice maker according to an embodiment.

FIG. 6 is a longitudinal cross-sectional view of an ice maker when a second tray is disposed at a water supply position according to an embodiment.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. A water supply part 240 may be installed on the upper side of the inner surface of the bracket 220. The water supply part 240 may be provided with openings at upper and lower sides so that water supplied to the upper side of the water supply part 240 may be guided to the lower side of the water supply part 240. Since the upper opening of the water supply part 240 is larger than the lower opening thereof, a discharge range of water guided downward through the water supply part 240 may be limited. A water supply pipe to which water is supplied may be installed above the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air.

The ice maker 200 may include a first tray 320 defining at least a portion of a wall for providing the ice making cell 320*a*, and a second tray 380 defining at least another portion of the wall for providing the ice making cell 320*a*. Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 contact each other, the complete ice making cell 320*a* may be defined. On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is formed. Accordingly, the first tray 320 may be referred to as an upper tray, and the second tray 380 may be referred to as a lower tray.

A plurality of ice making cells 320*a* may be defined by the first tray 320 and the second tray 380. In FIG. 4, three ice making cells 320*a* are provided as an example.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. In this case, the first cell 320*b* may be provided in a spherical shape or a shape similar to a spherical shape. Also, the second cell 320*c* may be provided in a spherical shape or a shape similar to a spherical shape. The ice making cell 320*a* may have a rectangular parallelepiped shape or a polygonal shape.

The ice maker 200 may further include a first tray case 300 coupled to the first tray 320.

For example, the first tray case 300 may be coupled to the upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the first heater case 280. The heater case 280 may be integrally formed with the first tray case 300 or may be separately formed. The ice separation heater 290 may be disposed at a position adjacent to the first tray 320. The ice separation heater 290 may be, for example, a wire type heater. For example, the ice separation heater 290 may be installed to contact the first tray 320 or may be disposed at a position spaced a predetermined distance from the first tray 320. In any cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320. The first tray cover 340 may be provided with an opening corresponding to a shape of the ice making cell 320*a* of the first tray 320 and may be coupled to a lower surface of the first tray 320.

The first tray case 300 may be provided with a guide slot 302 inclined at an upper side and vertically extending at a lower side. The guide slot 302 may be provided in a member extending upward from the first tray case 300. A guide protrusion 262 of the first pusher 260, which will be described later, may be inserted into the guide slot 302. Thus, the guide protrusion 262 may be guided along the guide slot 302. The first pusher 260 may include at least one extension part 264. For example, the first pusher 260 may include the extension part 264 provided with the same number as the number of ice making cells 320*a*, but is not limited thereto. The extension part 264 may push out the ice disposed in the ice making cell 320*a* during the ice separation process. For example, the extension part 264 may be inserted into the ice making cell 320*a* through the first tray case 300. Therefore, the first tray case 300 may be provided with a hole 304 through which a portion of the first pusher 260 passes.

The guide protrusion 262 of the first pusher 260 may be coupled to a pusher link 500. In this case, the guide protrusion 262 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380.

The second tray case 400 may be disposed at a lower side of the second tray to support the second tray 380. For example, at least a portion of the wall defining the second cell 320*a* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360. The second tray 380 may include a circumferential wall 382 surrounding a portion of the first tray 320 in a state of contacting the first tray 320. The second tray cover 360 may surround the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

On the other hand, at least one of the first tray 320 and the second tray 380 may be made of a resin including plastic so that the ice attached to the trays 320 and 380 is separated in the ice making process.

On the other hand, at least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. The transparent ice heater 430 may be, for example, a wire type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In any cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a '⊏' shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220. The second pusher 540 may include at least one extension part 544. For example, the second pusher 540 may include the extension part 544 provided with the same number as the number of ice making cells 320*a*, but is not limited thereto. The extension part 544 may push out the ice disposed in the ice making cell 320*a*. For example, the extension part 544 may pass through the second tray case 400 to contact the second tray 380 defining the ice making cell 320*a* and then press the contacting second tray 380. Therefore, the second tray case 400 may be provided with a hole 422 through which a portion of the second pusher 540 passes.

The first tray case 300 may be rotatably coupled to the second tray case 400 with respect to the shaft 440 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicone material. Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

For another example, the first tray 320 may be made of a metal material. In this case, since the coupling force or the separating force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260. Alternatively, the ice maker 200 may not include the ice separation heater 290 and the first pusher 260.

Although not limited, the second tray 320 may be made of, for example, a silicone material. That is, the first tray 320 and the second tray 380 may be made of the same material. When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

On the other hand, referring to FIG. 5, the ice maker 200 may further include a second temperature sensor (or a tray temperature sensor) 700 that senses the temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*. The second temperature sensor 700 may be installed in the first tray case 300.

In this case, the second temperature sensor 700 may contact the first tray 320, or may be spaced apart from the first tray 320 by a predetermined distance. Alternatively, the second temperature sensor 700 may be installed on the first tray 320 to contact the first tray 320.

Of course, when the second temperature sensor 700 is disposed to pass through the first tray 320, the temperature of water or ice of the ice making cell 320*a* may be directly sensed.

On the other hand, a portion of the ice separation heater 290 may be disposed higher than the second temperature sensor 700 and may be spaced apart from the second temperature sensor 700. An electric wire 701 coupled to the second temperature sensor 700 may be guided above the first tray case 300.

Referring to FIG. 6, the ice maker 200 according to this embodiment may be designed such that the position of the second tray 380 is different in the water supply position and the ice-making position. For example, the second tray 380 may include a second cell wall 381 defining the second cell 320*c* of the ice making cell 320*a*, and a circumferential wall 382 extending along the outer edge of the second cell wall 381.

The second cell wall 381 may include an upper surface 381*a*. In this specification, the upper surface 381*a* of the second cell wall 381 may be referred to as the upper surface 381*a* of the second tray 380.

The upper surface 381*a* of the second cell wall 381 may be disposed lower than the upper end of the circumferential wall 381.

The first tray 320 may include a first cell wall 321*a* defining the first cell 320*b* of the ice making cell 320*a*. The first cell wall 321*a* may include a straight portion 321*b* and a curved portion 321*c*. The curved portion 321*c* may be formed in an arc shape having a center of the shaft 440 as a radius of curvature. Accordingly, the circumferential wall 381 may also include a straight portion and a curved portion corresponding to the straight portion 321*b* and the curved portion 321*c*.

The first cell wall 321*a* may include a lower surface 321*d*. In this specification, the lower surface 321*b* of the first cell wall 321*a* may be referred to as the lower surface 321*b* of the first tray 320. The lower surface 321*d* of the first cell wall 321*a* may contact the upper surface 381*a* of the second cell wall 381*a*.

For example, at least a portion of the lower surface 321*d* of the first cell wall 321*a* and the upper surface 381*a* of the second cell wall 381 may be spaced apart at the water supply position as shown in FIG. 6. In FIG. 6, for example, it is shown that the lower surface 321*d* of the first cell wall 321*a* and the entire upper surface 381*a* of the second cell wall 381 are spaced apart from each other. Accordingly, the upper surface 381*a* of the second cell wall 381 may be inclined to form a predetermined angle with the lower surface 321*d* of the first cell wall 321*a*.

Although not limited, the lower surface 321*d* of the first cell wall 321*a* at the water supply position may be maintained substantially horizontally, and the upper surface 381*a* of the second cell wall 381 may be disposed to be inclined with respect to the lower surface 321*d* of the first cell wall 321*a* under the first cell wall 321*a*.

In the state shown in FIG. 6, the circumferential wall 382 may surround the first cell wall 321*a*. In addition, the upper end of the circumferential wall 382 may be disposed higher than the lower surface 321*d* of the first cell wall 321*a*. On the other hand, the upper surface 381*a* of the second cell wall 381 may contact at least a portion of the lower surface 321*d* of the first cell wall 321*a* at the ice making position (see FIG. 12). The angle formed by the upper surface 381*a* of the second tray 380 and the lower surface 321*d* of the first tray 320 at the ice making position is smaller than the angle formed by the upper surface 382*a* of the second tray 380 and the lower surface 321*d* of the first tray 320 at the water supply position. The upper surface 381*a* of the second cell wall 381 may contact the entire lower surface 321*d* of the first cell wall 321*a* at the ice making position. At the ice making position, the upper surface 381*a* of the second cell wall 381 and the lower surface 321*d* of the first cell wall 321*a* may be disposed to be substantially horizontal.

In this embodiment, the water supply position of the second tray 380 and the ice making position are different from each other so that, when the ice maker 200 includes a plurality of ice making cells 320*a*, a water passage for communication between the ice making cells 320*a* is not formed in the first tray 320 and/or the second tray 380, and water is uniformly distributed to the plurality of ice making cells 320*a*.

If the ice maker 200 includes the plurality of ice making cells 320*a*, when the water passage is formed in the first tray 320 and/or the second tray 380, the water supplied to the ice maker 200 is distributed to the plurality of ice making cells 320*a* along the water passage.

However, in a state in which the water is distributed to the plurality of ice making cells 320*a*, water also exists in the water passage, and when ice is made in this state, the ice made in the ice making cell 320*a* is connected by the ice made in the water passage.

In this case, there is a possibility that the ice will stick together even after the ice separation is completed. Even if pieces of ice are separated from each other, some pieces of ice will contain ice made in the water passage, and thus there is a problem that the shape of the ice is different from that of the ice making cell.

However, as in this embodiment, when the second tray 380 is spaced apart from the first tray 320 at the water supply position, water falling into the second tray 380 may be uniformly distributed to the plurality of second cells 320*c* of the second tray 380.

For example, the first tray 320 may include a communication hole 321*e*. When the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* among the plurality of communication holes 321*e*. In this case, the water supplied through the one communication hole 321*e* falls into the second tray 380 after passing through the first tray 320.

During the water supply process, water may fall into any one second cell 320*c* among the plurality of second cells 320*c* of the second tray 380. The water supplied to one second cell 320*c* overflows from one second cell 320*c*.

In this embodiment, since the upper surface 381*a* of the second tray 380 is spaced apart from the lower surface 321*d* of the first tray 320, the water that overflows from one of the second cells 320*c* moves to another adjacent second cell 320*c* along the upper surface 381*a* of the second tray 380. Accordingly, the plurality of second cells 320*c* of the second tray 380 may be filled with water.

In addition, in a state in which the supply of water is completed, a portion of the supplied water is filled in the second cell 320*c*, and another portion of the supplied water may be filled in a space between the first tray 320 and the second tray 380.

Water at the water supply position when water supply is completed may be positioned only in the space between the first tray 320 and the second tray 380, the space between the first tray 320 and the second tray 380, and the first tray 320 according to the volume of the ice making cell 320*a* (see FIG. 11).

When the second tray 380 moves from the water supply position to the ice making position, the water in the space between the first tray 320 and the second tray 380 may be uniformly distributed to the plurality of first cells 320*b*.

On the other hand, when the water passage is defined in the first tray 320 and/or the second tray 380, ice made in the ice making cell 320*a* is also made in the water passage portion.

In this case, when the controller of the refrigerator controls one or more of the cooling power of the cooling air supply part 900 and the heating amount of the transparent ice heater 430 to vary according to the mass per unit height of water in the ice making cell 320*a* in order to make transparent ice, one or more of the cooling power of the cold air supply means 900 and the heating amount of the transparent ice heater 430 are controlled to rapidly vary several times or more in the portion where the water passage is defined.

This is because the mass per unit height of water is rapidly increased several times or more in the portion where the water passage is defined. In this case, since the reliability problem of the parts may occur and expensive parts with large widths of maximum and minimum output may be used, it can also be disadvantageous in terms of power consumption and cost of parts. As a result, the present disclosure may require a technology related to the above-described ice making position so as to make transparent ice.

FIG. 7 is a block diagram illustrating a control of a refrigerator according to an embodiment.

Referring to FIG. 7, the refrigerator according to this embodiment may further include a cold air supply part 900 supplying cold air to the freezing compartment 32 (or the ice making cell). The cold air supply part 900 may supply cold air to the freezing compartment 32 using a refrigerant cycle. For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

In addition, the cold air supply part 900 may further include the evaporator exchanging heat between the refrigerant and the air. The cold air heat-exchanged with the evaporator may be supplied to the ice maker 200.

The refrigerator according to this embodiment may further include a controller 800 that controls the cold air supply part 900. The refrigerator may further include a water supply valve 242 controlling an amount of water supplied through the water supply part 240.

The controller 800 may control a portion or all of the ice separation heater 290, the transparent ice heater 430, the driver 480, the cold air supply part 900, and the water supply valve 242.

In this embodiment, when the ice maker 200 includes both the ice separation heater 290 and the transparent ice heater 430, an output of the ice separation heater 290 and an output of the transparent ice heater 430 may be different from each other.

When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented.

Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or an internal temperature sensor) that senses a temperature of the freezing compartment 32. The controller 800 may control the cold air supply part 900 based on the temperature sensed by the first temperature sensor 33.

The controller 800 may determine whether ice making is completed based on the temperature sensed by the second temperature sensor 700.

FIG. 8 is a flowchart for explaining a process of making ice in the ice maker according to an embodiment.

FIG. 9 is a view for explaining a height reference depending on a relative position of the transparent heater with respect to the ice making cell, and FIG. 10 is a view for explaining an output of the transparent heater per unit height of water in the ice making cell.

FIG. 11 is a view illustrating a state in which supply of water is completed at a water supply position, FIG. 12 is a view illustrating a state in which ice is made at an ice making position, FIG. 13 is a view illustrating a state in which a second tray is separated from a first tray during an ice separation process, and FIG. 14 is a view illustrating a state in which a second tray is moved to an ice separation position during an ice separation process.

Referring to FIGS. 6 to 14, to make ice in the ice maker 200, the controller 800 moves the second tray 380 to a water supply position (S1).

In this specification, a direction in which the second tray 380 moves from the ice making position of FIG. 12 to the ice separation position of FIG. 14 may be referred to as forward movement (or forward rotation). On the other hand, the direction from the ice separation position of FIG. 14 to the water supply position of FIG. 6 may be referred to as reverse movement (or reverse rotation).

The movement to the water supply position of the second tray 380 is detected by a sensor, and when it is detected that the second tray 380 moves to the water supply position, the controller 800 stops the driver 480.

The water supply starts when the second tray 380 moves to the water supply position (S2).

For the water supply, the controller 800 turns on the water supply valve 242, and when it is determined that a predetermined amount of water is supplied, the controller 800 may turn off the water supply valve 242. For example, in the process of supplying water, when a pulse is outputted from a flow sensor (not shown), and the outputted pulse reaches a reference pulse, it may be determined that a predetermined amount of water is supplied.

After the water supply is completed, the controller 800 controls the driver 480 to allow the second tray 380 to move to the ice making position (S3). For example, the controller 800 may control the driver 480 to allow the second tray 380 to move from the water supply position in the reverse direction.

When the second tray 380 move in the reverse direction, the upper surface 381*a* of the second tray 380 comes close to the lower surface 321*e* of the first tray 320. Then, water between the upper surface 381*a* of the second tray 380 and the lower surface 321*e* of the first tray 320 is divided into each of the plurality of second cells 320*c* and then is distributed. When the upper surface 381*a* of the second tray 380 and the lower surface 321*e* of the first tray 320 are completely in close contact, the first cell 320*b* is filled with water.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S4). For example, the ice making may be started when the second tray 380 reaches the ice making position. Alternatively, when the second tray 380 reaches the ice making position, and the water supply time elapses, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a*. When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S5).

In this embodiment, the transparent ice heater 430 is not turned on immediately after the ice making is started, and the transparent ice heater 430 may be turned on only when the turn-on condition of the transparent ice heater 430 is satisfied (S6).

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on.

For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature sensed by the second temperature sensor 700 reaches a turn-on reference temperature.

For example, the turn-on reference temperature may be a temperature for determining that water starts to freeze at the uppermost side (communication hole side) of the ice making cell 320*a*. When a portion of the water is frozen in the ice making cell 320*a*, the temperature of the ice in the ice making cell 320*a* is below zero. The temperature of the first tray 320 may be higher than the temperature of the ice in the ice making cell 320*a*.

Alternatively, although water is present in the ice making cell 320*a*, after the ice starts to be made in the ice making cell 320*a*, the temperature sensed by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the control part 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and a sum of the turn-on time and the turn-off time of the transparent ice heater 430 in one cycle, or a ratio of the turn-off time and a sum of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

For example, as shown in FIG. 9A, the transparent ice heater 430 at the bottom surface of the ice making cell 320*a* may be disposed to have the same height. In this case, a line connecting the transparent ice heater 430 is a horizontal line, and a line extending in a direction perpendicular to the horizontal line serves as a reference for the unit height of the water of the ice making cell 320*a*. In the case of FIG. 9A, ice is made from the uppermost side of the ice making cell 320*a* and then is grown.

On the other hand, as shown in FIG. 9B, the transparent ice heater 430 at the bottom surface of the ice making cell 320*a* may be disposed to have different heights. In this case, since heat is supplied to the ice making cell 320*a* at different heights of the ice making cell 320*a*, ice is made with a pattern different from that of FIG. 9A.

For example, in FIG. 9B, ice may be made at a position spaced apart from the uppermost side to the left side of the ice making cell 320*a*, and the ice may be grown to a right lower side at which the transparent ice heater 430 is disposed.

Accordingly, in FIG. 9B, a line (reference line) perpendicular to the line connecting two points of the transparent ice heater 430 serves as a reference for the unit height of water of the ice making cell 320*a*. The reference line of FIG. 9B is inclined at a predetermined angle from the vertical line.

FIG. 10 illustrates a unit height division of water and an output amount of transparent ice heater per unit height when the transparent ice heater is disposed as shown in FIG. 9A.

Hereinafter, an example of controlling an output of the transparent ice heater so that the ice making rate is constant for each unit height of water will be described.

Referring to FIG. 10, when the ice making cell 320*a* is formed, for example, in a spherical shape, the mass per unit height of water in the ice making cell 320*a* increases from the upper side to the lower side to reach the maximum and then decreases again.

For example, the water (or the ice making cell itself) in the spherical ice making cell 320*a* having a diameter of about 50 mm is divided into nine sections (section A to section I) by 6 mm height (unit height). Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections, Among the many sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice may be maximum.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value. Since the volume of the section D is less than that of the section E, the volume of the ice may be reduced as the volume decreases, and thus it is necessary to delay the ice making rate. Thus, an output W6 of the transparent ice heater 430 in the section D may be set to a value greater than an output W5 of the transparent ice heater 430 in the section E.

Since the volume in the section C is less than that in the section D by the same reason, an output W3 of the transparent ice heater 430 in the section C may be set to a value greater than the output W4 of the transparent ice heater 430 in the section D. Since the volume in the section B is less than that in the section C, an output W2 of the transparent ice heater 430 in the section B may be set to a value greater than the output W3 of the transparent ice heater 430 in the section C. Since the volume in the section A is less than that in the section B, an output W1 of the transparent ice heater 430 in the section A may be set to a value greater than the output W2 of the transparent ice heater 430 in the section B.

For the same reason, since the mass per unit height decreases toward the lower side in the section E, the output of the transparent ice heater 430 may increase as the lower side in the section E (see W6, W7, W8, and W9).

Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is minimum. The output of the transparent ice heater 430 may again increase step by step from the next section of the intermediate section.

The output of the transparent ice heater 430 in two adjacent sections may be set to be the same according to the type or mass of the made ice. For example, the output of section C and section D may be the same. That is, the output of the transparent ice heater 430 may be the same in at least two sections.

Alternatively, the output of the transparent ice heater 430 may be set to the minimum in sections other than the section in which the mass per unit height is the smallest.

For example, the output of the transparent ice heater 430 in the section D or the section F may be minimum. The output of the transparent ice heater 430 in the section E may be equal to or greater than the minimum output.

In summary, in this embodiment, the output of the transparent ice heater 430 may have a maximum initial output. In the ice making process, the output of the transparent ice heater 430 may be reduced to the minimum output of the transparent ice heater 430.

The output of the transparent ice heater 430 may be gradually reduced in each section, or the output may be maintained in at least two sections. The output of the transparent ice heater 430 may increase from the minimum output to the end output. The end output may be the same as or different from the initial output. In addition, the output of the transparent ice heater 430 may incrementally increase in each section from the minimum output to the end output, or the output may be maintained in at least two sections.

Alternatively, the output of the transparent ice heater 430 may be an end output in a section before the last section among a plurality of sections. In this case, the output of the transparent ice heater 430 may be maintained as an end output in the last section. That is, after the output of the transparent ice heater 430 becomes the end output, the end output may be maintained until the last section.

As the ice making is performed, an amount of ice existing in the ice making cell 320*a* may decrease. Thus, when the transparent ice heater 430 continues to increase until the output reaches the last section, the heat supplied to the ice making cell 320*a* may be reduced. As a result, excessive water may exist in the ice making cell 320*a* even after the end of the last section.

Therefore, the output of the transparent ice heater 430 may be maintained as the end output in at least two sections including the last section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may gradually increase.

The cooling power of the cold air supply part 900 may be maximum in the intermediate section in which the mass for each unit height of water is maximum. The cooling power of the cold air supply part 900 may be gradually reduced again from the next section of the intermediate section.

Alternatively, the transparent ice may be made by varying the cooling power of the cold air supply part 900 and the heating amount of the transparent ice heater 430 according to the mass per unit height of water.

For example, the heating power of the transparent ice heater 430 may vary so that the cooling power of the cold air supply part 900 is proportional to the mass per unit height of water. The heating power of the transparent ice heater 430 may be inversely proportional to the mass per unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature sensed by the second temperature sensor 700 (S8). When it is determined that the ice making is completed, the controller 800 may turn off the transparent ice heater 430 (S9).

For example, when the temperature sensed by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature sensed by the second temperature sensor 700 reaches a second reference temperature lower than the first reference temperature.

When the ice making is completed, the controller 800 operates one or more of the ice separation heater 290 and the transparent ice heater 430 (S10).

When at least one of the ice separation heater 290 or the transparent ice heater 430 is turned on, heat of the heater is transferred to at least one of the first tray 320 or the second tray 380 so that the ice may be separated from the surfaces (inner surfaces) of one or more of the first tray 320 and the second tray 380.

Also, the heat of the heaters 290 and 430 is transferred to the contact surface of the first tray 320 and the second tray 380, and thus, the lower surface 321*d* of the first tray 320 and the upper surface 381*a* of the second tray 380 may be in a state capable of being separated from each other.

When at least one of the ice separation heater 290 and the transparent ice heater 430 operate for a predetermined time, or when the temperature sensed by the second temperature sensor 700 is equal to or higher than an off reference temperature, the controller 800 is turned off the heaters 290 and 430, which are turned on (S10).

Although not limited, the turn-off reference temperature may be set to above zero temperature.

The controller 800 operates the driver 480 to allow the second tray 380 to move in the forward direction (S11).

As illustrated in FIG. 13, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, ice may be separated from the surface of the first tray 320 by the heater that is turned on. In this case, the ice may move together with the second tray 380 while the ice is supported by the second tray 380.

For another example, even when the heat of the heater is applied to the first tray 320, the ice may not be separated from the surface of the first tray 320.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* may press the ice contacting the first tray 320, and thus, the ice may be separated from the tray 320.

The ice separated from the first tray 320 may be supported by the second tray 380 again.

When the ice moves together with the second tray 380 while the ice is supported by the second tray 380, the ice may be separated from the tray 250 by its own weight even if no external force is applied to the second tray 380.

While the second tray 380 moves, even if the ice does not fall from the second tray 380 by its own weight, when the second pusher 540 presses the second tray 380 as illustrated in FIG. 13, the ice may be separated from the second tray 380 to fall downward.

Specifically, as illustrated in FIG. 13, while the second tray 380 moves, the second tray 380 may contact the extension part 544 of the second pusher 540. When the second tray 380 continuously moves in the forward direction, the extension part 544 may press the second tray 380 to deform the second tray 380. Thus, the pressing force of the extension part 544 may be transferred to the ice so that the ice is separated from the surface of the second tray 380. The ice separated from the surface of the second tray 380 may drop downward and be stored in the ice bin 600.

In this embodiment, as shown in FIG. 14, the position at which the second tray 380 is pressed by the second pusher 540 and deformed may be referred to as an ice separation position.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the ice state.

After the ice is separated from the second tray 380, the controller 800 controls the driver 480 to allow the second tray 380 to move in the reverse direction (S11). Then, the second tray 380 moves from the ice separation position to the water supply position.

When the second tray 380 moves to the water supply position of FIG. 6, the controller 800 stops the driver 480 (S1).

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

FIG. 15 is a view for explaining a method for controlling a refrigerator when a heat transfer amount between cold air and water varies in an ice making process, and FIG. 16 is a graph showing a change in output of a transparent ice heater according to an increase/decrease in heat transfer amount of cold air and water. FIG. 17 is a view illustrating an output for each control process of a transparent ice heater in an ice making process.

Referring to FIGS. 15 to 17, cooling power of the cold air supply part 900 may be determined corresponding to the target temperature of the freezing compartment 32. The cold air generated by the cold air supply part 900 may be supplied to the freezing compartment 32.

The water of the ice making cell 320*a* may be phase-changed into ice by heat transfer between the cold water supplied to the freezing compartment 32 and the water of the ice making cell 320*a*.

In this embodiment, a heating amount of the transparent ice heater 430 for each unit height of water may be determined in consideration of predetermined cooling power of the cold air supply part 900.

In this embodiment, the heating amount of the transparent ice heater 430 determined in consideration of the predetermined cooling power of the cold air supply part 900 is referred to as a reference heating amount. The magnitude of the reference heating amount per unit height of water is different.

However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, the case in which the heat transfer amount between the cold and the water decrease may be a case in which the cooling power of the cold air supply part 900 decreases or a case in which the air having a temperature higher than the temperature of the cold air in the freezing compartment 32 is supplied to the freezing compartment 32.

For example, when a target temperature of the freezing compartment 32 is lowered, an operation mode of the freezing compartment 32 is changed from a normal mode to a quick cooling mode, an output of at least one of the compressor or the fan increases, or an opening degree increases, the cooling power of the cold air supply part 900 may increase. In addition, when the refrigerator door is opened or the defrosting operation is performed, air having a temperature higher than the temperature of the cold air in the freezing compartment 32 may be supplied to the freezing compartment 32.

On the other hand, when the target temperature of the freezer compartment 32 increases, the operation mode of the freezing compartment 32 is changed from the quick cooling mode to the normal mode, the output of at least one of the compressor or the fan decreases, or the opening degree of the refrigerant valve decreases, the cooling power of the cold air supply part 900 may decrease. When the cooling power of the cold air supply part 900 increases, the temperature of the cold air around the ice maker 200 is lowered to increase in ice making rate.

On the other hand, if the cooling power of the cold air supply part 900 decreases, the temperature of the cold air around the ice maker 200 increases, the ice making rate decreases, and also, the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

When the cooling power of the cold air supply part 900 increases, the heating amount of transparent ice heater 430 may increase. On the other hand, when the cooling power of the cold air supply part 900 decreases, the heating amount of transparent ice heater 430 may decrease.

Hereinafter, the control of the transparent ice heater 430 when the heat transfer amount of the cold air and water is maintained constant during the ice making process will be described. As an example, as a case in which the temperature of the freezing compartment 32 is relatively weak, a case in which the temperature of the freezing compartment 32 is a first temperature value will be described.

The method for controlling the transparent ice heater for making transparent ice may include a basic heating process and an additional heating process. An additional heating process may be performed after the end of the basic heating process. Hereinafter, an example of controlling the output of the transparent ice heater among the heating amounts of the transparent ice heater will be described. The method for controlling the output of the transparent ice heater may be applied in the same manner as or in the similar manner to the method for controlling the duty of the transparent ice heater.

The basic heating process may include a plurality of processes. In FIG. 17, as an example, it is shown that the basic heating process includes ten processes.

In each of the plurality of processes, the output of the transparent ice heater 430 is predetermined. In each process, the output of the transparent ice heater 430 may be determined based on the mass per unit height of water in the ice making cell 320*a*.

As described above, when the on condition of the transparent ice heater 430 is satisfied, the first process of the basic heating process may be started. In the first process, the output of the transparent ice heater 430 may be A1.

When the first process starts and the first set time T1 elapses, the second process may start. At least one of the plurality of processes may be performed for the first set time T1. For example, the time at which each of the plurality of processes is performed may be the same as the first set time T1. That is, when each process starts and the first set time T1 elapses, each process may be ended. Accordingly, the output of the transparent ice heater 430 may be variably controlled over time.

As another example, even if the tenth process, which is the last process among the plurality of processes, starts and the first set time T1 elapses, the tenth process may not be immediately ended. In this case, when the temperature sensed by the second temperature sensor 700 reaches a limit temperature, the tenth process may be ended.

The limit temperature may be set to a sub-zero temperature. When the door is opened during the ice making process, or when the defrost heater is operated, or when heat having a temperature higher than the temperature of the freezing compartment is provided to the freezing compartment, the temperature of the freezing compartment 32 may increase.

When an additional ice maker and ice bin are provided in the door, the ice maker provided in the door may receive cold air for cooling the freezing compartment 32 and make ice. When full ice is detected in the ice bin provided in the door, the cooling power of the cold air supply part 900 may be less than the cooling power before the detection of the full ice.

When the output of the transparent ice heater 430 is controlled according to time in the basic heating process as in this embodiment, the transparent ice heater 430 operates according to the output at each process, regardless of the increase in the temperature of the freezing compartment 32 or the decrease in the cooling power of the cold air supply part 900. Thus, there is a possibility that water does not phase-change into ice in the ice making cell 320*a*. That is, even if the tenth process in the basic heating process is performed for the first set time T1, the temperature sensed by the second temperature sensor 700 may be higher than the limit temperature.

Therefore, to reduce the amount of unfrozen water in the ice making cell 320*a* after the end of the tenth process, the tenth process may be ended when the first set time T1 elapses and the temperature sensed by the second temperature sensor 700 reaches the limit temperature.

After the basic heating process is ended, an additional heating process may be performed.

When the ice maker 200 includes a plurality of ice making cells 320*a*, the amount of heat transfer between water and cold air in each ice making cell 320*a* is not constant. Thus, the speed at which ice is made in the plurality of ice making cells 320*a* may be different from each other.

For example, after the basic heating process is ended, water may completely change into ice in some ice making cells 320*a* among the plurality of ice making cells 320*a*, but some of the water may not phase-change into ice in other ice making cells 320*a*. In this state, if the ice breaking process is performed after the end of the basic heating process, there may be a problem in that water present in the ice making cell 320*a* falls downward. Accordingly, the additional heating process may be performed after the basic heating process is ended, so that transparent ice may be made in each of the plurality of ice making cells 320*a*.

The additional heating process may include a process (an eleventh process or a first additional process) of operating the transparent ice heater 430 with a set output for a second set time T2.

Since heat transfer between the cold air and the water occurs even in the additional heating process, the transparent ice heater 430 may operate with a set output A11 to make transparent ice.

The output A11 of the transparent ice heater 430 in the eleventh process may be the same as the output of the transparent ice heater 430 in one of the plurality of processes of the basic heating process.

For example, the output A11 of the transparent ice heater 430 may be the same as the minimum output of the transparent ice heater 430 in the basic heating process. The second set time T2 may be longer than the first set time T1.

When the eleventh process is performed, even if the amount of water supplied to the ice making cell 320*a* is smaller than a set amount, the water may phase-change into ice in the ice making cell 320*a*.

Even if the amount of water supplied to the ice making cell 320*a* is smaller than the set amount, the output of the transparent ice heater 430 may be set as a predetermined reference output.

In this case, the amount of heat supplied from the transparent ice heater 430 is large compared to the mass of water in the ice making cell 320*a* during the ice making process. Accordingly, even if the basic heating process is ended due to the slowing of the ice making rate in the ice making cell 320*a*, there is a possibility that water will exist in the ice making cell 320*a*.

In such a situation, when the eleventh process is performed, heat is transferred to water and cold air while the minimum amount of heat is supplied to the ice making cell 320*a*, so that water may be completely phase-changed into ice in the ice making cell 320*a*.

The additional heating process may further include a process (a twelfth process or a second additional process) of operating the transparent ice heater 430 with a set output A12 after the eleventh process. The output A12 of the transparent ice heater 430 in the twelfth process may be the same as or different from the output A11 of the transparent ice heater 430 in the eleventh process. When the third set time T3 elapses or the temperature sensed by the second temperature sensor 700 before the elapse of the third set time T3 reaches the end reference temperature, the twelfth process may be ended. The third set time T3 may be equal to or shorter than the second set time T2.

When the temperature sensed by the second temperature sensor 700 reaches the end reference temperature, the twelfth process is ended, and as a result, the additional heating process may be ended. When the additional heating process is ended, the ice separation process may be performed.

The additional heating process may further include a process (a thirteenth process or a third additional process) of operating the transparent ice heater 430 with a set output A13 after the twelfth process. The thirteenth process may be performed when the twelfth process is performed for the third set time T3 but the temperature sensed by the second temperature sensor 700 does not reach the end reference temperature. The end reference temperature may be set to a temperature lower than the limit temperature, and may be a reference temperature for determining that ice is completely made in the ice making cell 320*a*.

As described above, when the door is opened during the ice making process, or when the defrost heater is operated, or when heat having a temperature higher than the temperature of the freezing compartment 32 is provided to the freezing compartment 32, the temperature of the freezing compartment 32 may increase. When full ice is detected in the ice bin provided in the door, the cooling power of the cold air supply part 900 for supplying cold air to the freezing compartment 32 may be reduced.

At this time, when the temperature increasing width of the freezing compartment 32 is large or the cooling power of the cold air supply part 900 decreases, ice may not be completely made in the ice making cell 320*a* even after the basic heating process and the eleventh and twelfth processes are performed.

Accordingly, after the end of the twelfth process, the transparent ice heater 430 may operate with a set output A13 so that water remaining in the ice making cell 320*a* can be phase-changed into ice.

The output A13 of the transparent ice heater 430 in the thirteenth process may be equal to or less than the output A12 of the transparent ice heater 430 in the twelfth process. The output A13 of the transparent ice heater 430 in the thirteenth process may be less than the minimum output of the transparent ice heater 430 in the basic heating process. When a fourth set time T4 elapses or the temperature sensed by the second temperature sensor 700 before the fourth set time T4 reaches the end reference temperature, the thirteenth process may be ended. The fourth set time T4 may be equal to or different from the third set time T3.

When the temperature sensed by the second temperature sensor 700 reaches the end reference temperature, the thirteenth process is ended, and as a result, the additional heating process may be ended. When the additional heating process is ended, the ice separation process may be performed.

The additional heating process may further include a process (a fourteenth process or a fourth additional process) of operating the transparent ice heater 430 with a set output A14 after the thirteenth process. The fourteenth process may be performed when the thirteenth process is performed for the fourth set time T4 but the temperature sensed by the second temperature sensor 700 does not reach the end reference temperature. The output A14 of the transparent ice heater 430 in the fourteenth process may be less than the output A13 of the transparent ice heater 430 in the thirteenth process. When a fifth set time T5 elapses or the temperature sensed by the second temperature sensor 700 before the fifth set time T5 reaches the end reference temperature, the fourteenth process may be ended. The fifth set time T5 may be equal to or different from the fourth set time T4.

When the temperature sensed by the second temperature sensor 700 reaches the end reference temperature, the fourteenth process is ended, and as a result, the additional heating process may be ended. When the additional heating process is ended, the ice separation process may be performed.

The additional heating process may further include a process (a fifteenth process or a fifth additional process) of operating the transparent ice heater 430 with a set output A15 after the fourteenth process. The fifteenth process may be performed when the fourteenth process is performed for the fifth set time T5 but the temperature sensed by the second temperature sensor 700 does not reach the end reference temperature. The output A15 of the transparent ice heater 430 in the fifteenth process may be less than the output A14 of the transparent ice heater 430 in the fourteenth process. The output A14 of the transparent ice heater 430 in the fifteenth process may be set to ½ of the output A14 of the transparent ice heater 430 in the fourteenth process.

When the sixth set time T6 elapses or the temperature sensed by the second temperature sensor 700 before the elapse of the sixth set time T6 reaches the end reference temperature, the fifteenth process may be ended. The sixth set time T6 may be longer than the first to fifth set times T1 to T5.

The maximum output of the transparent ice heater 430 in the additional heating process is less than the maximum output of the transparent ice heater 430 in the basic heating process. The minimum output of the transparent ice heater 430 in the additional heating process is less than the minimum output of the transparent ice heater 430 in the basic heating process.

When the fifteenth process is ended, the additional heating process may be finally ended.

Hereinafter, the case in which the target temperature of the freezing compartment 32 varies will be described with an example.

The controller 800 may control the output of the transparent ice heater 430 so that the ice making rate may be maintained within the predetermined range regardless of the target temperature of the freezing compartment 32.

For example, the ice making may be started (S4), and a change in heat transfer amount of cold and water may be detected (S31). For example, it may be sensed that the target temperature of the freezing compartment 32 is changed through an input part (not shown).

The controller 800 may determine whether the heat transfer amount of cold and water increases (S32). For example, the controller 800 may determine whether the target temperature increases.

As the result of the determination in the process S32, when the target temperature of the freezing compartment 32 increases, the controller 800 may decrease the reference heating amount of transparent ice heater 430 that is predetermined in each of the current section and the remaining sections.

The variable control of the heating amount of the transparent ice heater 430 may be normally performed until the ice making is completed (S35).

On the other hand, if the target temperature of the freezing compartment 32 decreases, the controller 800 may increase the reference heating amount of transparent ice heater 430 that is predetermined in each of the current section and the remaining sections. The variable control of the heating amount of the transparent ice heater 430 may be normally performed until the ice making is completed (S35).

In this embodiment, the reference heating mount that increases or decreases may be predetermined and then stored in a memory.

When ice making starts while the target temperature of the freezing compartment 32 is set to medium, or when the target temperature of the freezing compartment 32 changes from weak to medium during the ice making process, the output of the transparent ice heater 430 operates with an output determined when the target temperature of the freezing compartment 32 is medium (when the temperature of the freezing compartment 32 is a second temperature value lower than a first temperature value).

For example, in the basic heating process, the output of the transparent ice heater 430 may be controlled to B1 to B10.

In addition, the additional heating process may be performed after the basic heating process.

The contents of the set times (T1 to T6) and the end reference temperature described above may be equally applied even when the target temperature of the freezing compartment 32 is medium.

The outputs B11 to B15 of the transparent ice heater 430 in the eleventh to fifteenth processes when the target temperature of the freezing compartment 32 is medium may be greater than the outputs A11 to A15 of the transparent ice heater 430 in the eleventh to fifteenth processes.

The output B11 of the transparent ice heater 430 in the eleventh process may be equal to the output of the transparent ice heater 430 in one of the plurality of processes of the basic heating process.

For example, the output B11 of the transparent ice heater 430 in the eleventh process may be equal to the minimum output in the basic heating process. The output B12 of the transparent ice heater 430 in the twelfth process may be equal to or different from the output B11 of the transparent ice heater 430 in the eleventh process. The output B13 of the transparent ice heater 430 in the thirteenth process may be equal to or different from the output B11 of the transparent ice heater 430 in the twelfth process.

The output B13 of the transparent ice heater 430 in the thirteenth process when the target temperature of the freezing compartment 32 is medium may be equal to or different from the maximum output of the transparent ice heater 430 in the basic heating process when the target temperature of the freezing compartment 32 is weak.

The output B14 of the transparent ice heater 430 in the fourteenth process may be less than the output B13 of the transparent ice heater 430 in the thirteenth process.

The output B14 of the transparent ice heater 430 in the fourteenth process when the target temperature of the freezing compartment 32 is medium may be equal to or different from the maximum output of the transparent ice heater 430 in the basic heating process when the target temperature of the freezing compartment 32 is weak.

The output B15 of the transparent ice heater 430 in the fourteenth process may be less than the output B14 of the transparent ice heater 430 in the fourteenth process. The output B15 of the transparent ice heater 430 in the fifteenth process may be set to ½ of the output B14 of the transparent ice heater 430 in the fourteenth process.

When ice making starts while the target temperature of the freezing compartment 32 is set to strong, or when the target temperature of the freezing compartment 32 changes to strong during the ice making process, the output of the transparent ice heater 430 operates with an output determined when the target temperature of the freezing compartment 32 is strong (when the temperature of the freezing compartment 32 is a third temperature value lower than a second temperature value).

For example, in the basic heating process, the output of the transparent ice heater 430 may be controlled to C1 to C10. In addition, the additional heating process may be performed after the basic heating process.

The contents of the set times (T1 to T6) and the end reference temperature described above may be equally applied even when the target temperature of the freezing compartment 32 is strong.

The outputs C11 to C15 of the transparent ice heater 430 in the eleventh to fifteenth processes when the target temperature of the freezing compartment 32 is strong may be greater than the outputs B11 to B15 of the transparent ice heater 430 in the eleventh to fifteenth processes when the target temperature of the freezing compartment 32 is medium.

The output C11 of the transparent ice heater 430 in the eleventh process may be equal to the output of the transparent ice heater 430 in one of the plurality of processes of the basic heating process.

For example, the output C11 of the transparent ice heater 430 in the eleventh process may be equal to the minimum output in the basic heating process. The output C12 of the transparent ice heater 430 in the twelfth process may be equal to or different from the output C11 of the transparent ice heater 430 in the eleventh process. The output C13 of the transparent ice heater 430 in the thirteenth process may be equal to or different from the output C11 of the transparent ice heater 430 in the twelfth process.

The output C13 of the transparent ice heater 430 in the thirteenth process when the target temperature of the freezing compartment 32 is strong may be equal to or different from the maximum output of the transparent ice heater 430 in the basic heating process when the target temperature of the freezing compartment 32 is strong.

The output C14 of the transparent ice heater 430 in the fourteenth process may be less than the output C13 of the transparent ice heater 430 in the thirteenth process.

The output C14 of the transparent ice heater 430 in the fourteenth process when the target temperature of the freezing compartment 32 is strong may be equal to or different from the maximum output of the transparent ice heater 430 in the basic heating process when the target temperature of the freezing compartment 32 is medium.

The output C15 of the transparent ice heater 430 in the fourteenth process may be less than the output C14 of the transparent ice heater 430 in the fourteenth process. The output C15 of the transparent ice heater 430 in the fifteenth process may be set to ½ of the output C14 of the transparent ice heater 430 in the fourteenth process.

In the above embodiment, the additional heating process may include only the eleventh and twelfth processes, or may include only the thirteenth to fifteenth processes.

When the additional heating process includes only the eleventh and twelfth processes, the additional heating process may be ended while the output of the transparent ice heater 430 is maintained constant in the additional heating process.

For example, when the additional heating process does not include the eleventh and twelfth processes, the thirteenth process may be performed immediately after the basic heating process is ended. In this case, the thirteenth to fifteenth processes may be referred to as first to third additional processes. Of course, the fourteenth or fifteenth process may not be performed according to the temperature sensed by the second temperature sensor.

Alternatively, the additional heating process may include at least the eleventh process and the thirteenth process.

According to this embodiment, the reference heating amount for each section of the transparent ice heater increases or decreases in response to the change in the heat transfer amount of cold and water, and thus, the ice making rate may be maintained within the predetermined range, thereby realizing the uniform transparency for each unit height of the ice.

In the additional heating process, the output of the transparent ice heater 430 may vary according to the space temperature of the space (for example, the indoor space) in which the refrigerator is disposed in the basic heating process.

For example, if the space temperature is high, the condensing temperature of the condenser that exchanges heat with the air in the space is high, the operating time of the compressor is increased, and the cooling power of the compressor is increased. Thus, the temperature of the cold air supplied to the ice maker 200 is reduced. Accordingly, the output of the transparent ice heater 430 may be increased in response to the reduction in the temperature of the cold air supplied to the ice maker 200.

In response to the increase in the output of the transparent ice heater 430 in the basic heating process, the controller 800 may perform control so that the output of the transparent ice heater 430 in the additional heating process is greater compared to the case in which the temperature of the space in which the refrigerator is disposed in the basic heating process is low.

In addition, the defrosting operation may be performed in the additional heating process. The defrosting heater may be turned on in the defrosting operation. When the defrosting heater is turned on, the temperature of the storage chamber may be increased by the heat of the defrosting heater. When the temperature of the storage chamber increases, the output of the transparent ice heater 430 may decrease. The output of the transparent ice heater 430 may be determined in the additional heating process according to the length of the defrosting time.

The controller 800 may perform control so that the output of the transparent ice heater 430 in the additional heating process is smaller when the defrosting operation time in the basic heating process is long than when the defrosting operation time in the basic heating process is short.

In addition, the refrigerator door may be opened or closed in the basic heating process. When the refrigerator door is opened, air outside the refrigerator may flow into the storage chamber, and thus the temperature of the storage chamber may increase. As the opening time of the refrigerator door is longer, the temperature increase width of the storage chamber is greater. In the basic heating process, the controller 800 may reduce the output of the transparent ice heater 430 in response to the decrease in the heat transfer amount of cold air and water due to the opening of the refrigerator door. In addition, the controller 800 may perform control so that the output of the transparent ice heater 430 in the additional heating process is smaller when the opening time of the refrigerator door in the basic heating process is long than when the opening time of the refrigerator door in the basic heating process is short.

On the other hand, the operation of the transparent ice heater 430 may be controlled for ice separation.

For example, after the basic heating process is ended, the controller 800 may turn on the transparent ice heater 430 so as to move the second tray 380. In addition, the ice separation heater 290 may be turned on ice is separated from the first tray 320 after the basic heating process is ended, and the first tray 320 and the second tray 380 are easily separated.

When the turn-off condition of the ice separation heater 290 and the transparent ice heater 430 is satisfied, the ice separation heater 290 and the transparent ice heater 430 may be turned off. A portion of the ice in the ice making cell 320*a* may be melted by the heat of the heaters 290 and 430.

The ice separation heater 290 and the transparent ice heater 430 may be turned off to prevent the ice melted in the ice making cell 320*a* during the ice separation process from falling downward, and the second tray 380 may be moved to the ice separation position after the set time elapses.

According to another embodiment, it may be considered that the method for controlling the transparent ice heater includes only the basic heating process. In this case, the ice separation process may be performed after the basic heating process.

In the last process among the plurality of processes in the basic heating process, the output of the transparent ice heater 430 may be set to higher than the reference output of the transparent ice heater 430, which is calculated based on the mass per unit height of water.

The output of the transparent ice heater 430 in the last process among the plurality of processes may be set to be greater than the output of the previous process.

This is done for facilitating the ice separation after the basic heating process is ended. That is, by increasing the output of the transparent ice heater 430 in the last process before the basic heating process is ended, ice in the ice making cell 320*a* may be easily separated from the trays 320 and 380. When the basic heating process is ended, the transparent ice heater 430 may be turned off.

When the basic heating process is ended, the ice separation process may be performed. The transparent ice heater 430 may be turned off so that the ice melted in the ice making cell 320*a* is prevented from falling downward during the ice separation process, and the ice separation heater 430 may be turned on when the set time elapses.

According to another embodiment, the output of the transparent ice heater 430 in the additional heating process may be determined based on the temperature of the refrigerating compartment in the basic heating process.

Depending on the type of refrigerator, the refrigerator may supply cold air to the freezing compartment by using one evaporator, and cold air of the freezing compartment may flow into the refrigerating compartment that controls the damper provided in the duct. Other types of refrigerators may supply cold air to the freezing compartment and the refrigerating compartment by using the freezing compartment evaporator and the refrigerating compartment evaporator, respectively. However, the freezing compartment evaporator and the refrigerating compartment evaporator may be alternately operated.

In any case, when the target temperature of the refrigerating compartment is low, the supply of cold air to the refrigerating compartment increases. Thus, the supply of cold air to the freezing compartment is relatively reduced. In this case, the temperature of the freezing compartment increases. In response to the increase in the temperature of the freezing compartment, the output of the transparent ice heater 430 may be controlled to decrease in the basic heating process. On the other hand, when the target temperature of the refrigerating compartment is high, the supply of cold air to the freezing compartment is increased, and thus the output of the transparent ice heater 430 may be controlled to increase in the basic heating process.

The controller 800 may perform control so that the output of the transparent ice heater 430 in the additional heating process is greater when the target temperature of the refrigerating compartment in the basic heating process is high than when the target temperature of the refrigerating compartment in the basic heating process is low.

As another example, when full ice is detected in the ice bin provided in the door, the cooling power of the cold air supply part 900 for supplying cold air to the freezing compartment 32 may be reduced in the basic heating process. In response to this, the controller 800 may perform control so that the output of the transparent ice heater 430 in the additional heating process is greater when the full ice is not detected than when the full ice is detected in the ice bin provided in the door during the basic heating process.

The invention claimed is:

1. A refrigerator, comprising:

a storage chamber;

a cooler configured to supply cold air;

a tray configured to form a cell, which is configured to form a space in which liquid is phase-changed into ice;

a heater configured to supply heat to the cell; and a controller configured to control the heater to operate during an ice making process according to a first heating process and a second heating process performed after the first heating process, such that:

in the first heating process, the controller is configured to control the heater so that a heating amount of the heater varies, and in at least a partial section of the second heating process, the controller is configured to control the heater so that a heating amount is equal to or less than the heating amount in the first heating process, wherein the first heating process comprises a plurality of processes of operating the heater, and the second heating process comprises a first additional process of operating the heater, the controller is configured to:

control the heater such that a heating amount of the heater in one process of the plurality of processes is less than a heating amount of the heater in a next process performed after the one process, control the heater such that in the first additional process the heater is operated to have a predetermined heating amount for a second predetermined time, control the heater such that the predetermined heating amount of the heater in the first additional process is less than the heating amount of the heater in the next process of the first heating process, and control the heater such that the one process is performed for a first predetermined time, and the first predetermined time is less than the second predetermined time.

2. The refrigerator of claim 1, wherein the controller is configured to control the heater such that the heating amount of the heater varies for each of the plurality of processes.

3. The refrigerator of claim 1, further comprising a temperature sensor provided in the tray, wherein the controller is configured to end the first heating process when a temperature sensed by the temperature sensor reaches a limit temperature.

4. The refrigerator of claim 1, wherein the second heating process comprises a second additional process that is performed after the first additional process, and the controller is configured to control the heater such that a heating amount of the heater in the second additional process is equal to or less than the heating amount of the heater in the first additional process.

5. The refrigerator of claim 4, wherein the second additional process is performed for a third predetermined time, and the third predetermined time is less than the second predetermined time.

6. The refrigerator of claim 5, wherein:

the second heating process comprises a third additional process that is performed after the second additional process, and the controller is configured to control the heater such that a heating amount of the heater in the third additional process is equal to or less than the heating amount of the heater in the second additional process.

7. The refrigerator of claim 6, wherein:

the third additional process is performed for a fourth predetermined time which is equal to or less than the third predetermined time.

8. The refrigerator of claim 4, further comprising a temperature sensor provided in the tray, wherein:

the second heating process comprises a third additional process that is performed when a temperature sensed by the temperature sensor does not reach an end reference temperature when a third predetermined time elapses, and the controller is configured to control the heater such that a heating amount of the heater in the third additional process is equal to or less than the heating amount of the heater in the second additional process.

9. The refrigerator of claim 8, wherein the second heating process comprises a fourth additional process that is performed when the temperature sensed by the temperature sensor does not reach the end reference temperature when a fourth predetermined time elapses, and the controller is configured to control the heater such that a heating amount of the heater in the fourth additional process is less than the heating amount of the heater in the third additional process.

10. The refrigerator of claim 9, wherein:

the second heating process comprises a fifth additional process that is performed when the temperature sensed by the temperature sensor does not reach the end reference temperature when a fifth predetermined time elapses, and the controller is configured to control the heater such that a heating amount of the heater in the fifth additional process is less than the heating amount of the heater in the fourth additional process.

11. The refrigerator of claim 10, wherein the controller is configured to control the heater such that the heating amount of the heater in the fifth additional process is ½ of the heating amount of the heater in the fourth additional process.

12. The refrigerator of claim 1, wherein the controller is configured to control the heater such that the heating amount of the heater in the first additional process is less than the heating amount of the heater when the first heating process is ended.

13. The refrigerator of claim 1, wherein the controller is configured to control the heater such that the heating amount of the heater in the first additional process is equal to a lowest heating amount occurring in the first heating process.

14. The refrigerator of claim 1, wherein:

the controller is configured to control the heater such that the predetermined heating amount of the heater in the first additional process is less than a lowest heating amount of the heater occurring in the first heating process.

15. The refrigerator of claim 14, further comprising a temperature sensor provided in the tray, wherein:

the second heating process comprises a second additional process that is performed when the temperature sensed by the temperature sensor does not reach an end reference temperature when a fourth predetermined time elapses, and the controller is configured to control the heater such that a heating amount of the heater in the second additional process is less than the predetermined heating amount of the heater in the first additional process.

16. The refrigerator of claim 15, wherein:

the second heating process comprises a third additional process that is performed when the temperature sensed by the temperature sensor does not reach the end reference temperature when a fifth set time elapses, and the controller is configured to control the heater such that a heating amount of the heater in the third additional process is less than the heating amount of the heater in the second additional process.

17. The refrigerator of claim 1, wherein the tray includes a first tray defining a first portion of the cell and a second tray defining a second portion of the cell.

18. A refrigerator comprising:

a storage chamber;

a cooler configured to supply cold air;

a tray configured to form a cell, which is configured to form a space in which liquid is phase-changed into ice;

a temperature sensor provided in the tray;

a heater configured to supply heat to the cell; and a controller configured to control the heater to operate during an ice making process according to a first heating process and a second heating process after the first heating process, wherein the first heating process comprises a plurality of processes, the controller is configured to control the heater such that a heating amount of at least one process of the plurality of processes increases or decreases in response to a change in a heat transfer amount of the cold air and liquid in the tray;

wherein, in at least a partial section of the second heating process, the controller is configured to control the heater such that a heating amount of the heater is equal to or less than a heating amount of the heater in the first heating process.

19. The refrigerator of claim 18, wherein:

the plurality of processes including a first process and a second process, and the controller is configured to control a procession from the first process to the second process when a predetermined time elapses or the controller is configured to control a procession from the first process to the second process when a value measured by the temperature sensor reaches a first predetermined value, and the controller is configured to control the heater such that the first heating process is ended when the value measured by the temperature sensor reaches a second predetermined value.

20. The refrigerator of claim 18, wherein, in the first heating process, the controller is configured to control the cooler such that an amount of cold air supplied varies according to a mass per unit height of ice forming in the space of the cell.

21. The refrigerator of claim 18, wherein the controller is configured to control the cooler such that an amount of cold air supplied by the cooler when a mass per unit height of the ice is a first mass per unit height is greater than the amount of cold air supplied by the cooler when the mass per unit height is a second mass per unit height, the first mass per unit height being greater than the second mass per unit height.

22. The refrigerator of claim 18, wherein the controller is configured to control the heater such that a heating amount when a mass per unit height of the ice is a first mass per unit height is less than a heating amount supplied when the mass per unit height is a second mass per unit height, the first mass per unit height being greater than the second mass per unit height.

23. The refrigerator of claim 18, wherein:

the second heating process comprises a plurality of processes, the plurality of processes including a first process and a second process, the controller is configured to control a procession from the first process to the second process when a predetermined time elapses or when a value measured by the temperature sensor reaches a predetermined value.

24. The refrigerator of claim 18, wherein in response to a defrosting heater being turned on, the heating amount of at least one process of the plurality of processes decreases.

* * * * *